US010267255B2

(12) United States Patent
Okazaki

(10) Patent No.: US 10,267,255 B2
(45) Date of Patent: Apr. 23, 2019

(54) CONTROL SYSTEM OF INTERNAL COMBUSTION ENGINE

(71) Applicant: TOYOTA JIDOSHA KABUSHIKI KAISHA, Toyota-shi, Aichi (JP)

(72) Inventor: Shuntaro Okazaki, Sunto-gun (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 90 days.

(21) Appl. No.: 15/329,832

(22) PCT Filed: Jul. 28, 2015

(86) PCT No.: PCT/JP2015/003791
§ 371 (c)(1),
(2) Date: Jan. 27, 2017

(87) PCT Pub. No.: WO2016/017157
PCT Pub. Date: Feb. 4, 2016

(65) Prior Publication Data

US 2017/0248095 A1 Aug. 31, 2017

(30) Foreign Application Priority Data

Jul. 28, 2014 (JP) ..... 2014-153335

(51) Int. Cl.
*F02D 41/12* (2006.01)
*F01N 3/08* (2006.01)
(Continued)

(52) U.S. Cl.
CPC ..... *F02D 41/2432* (2013.01); *F01N 3/0864* (2013.01); *F01N 13/008* (2013.01);
(Continued)

(58) Field of Classification Search
CPC .... F01N 13/008; F01N 3/0864; F02D 41/126; F02D 41/1454; F02D 41/2432; F02D 41/2474
(Continued)

(56) References Cited

U.S. PATENT DOCUMENTS 9,695,731 B2 * 7/2017 Krengel ..... F01N 11/00
2001/0040104 A1 * 11/2001 Patrick ..... G01N 27/419 205/784.5
(Continued)

FOREIGN PATENT DOCUMENTS

CN 102102593 A 6/2011
DE 199 11 664 A1 9/2000
(Continued)

*Primary Examiner* — Audrey K Bradley
*Assistant Examiner* — Dapinder Singh
(74) *Attorney, Agent, or Firm* — Finnegan, Henderson, Farabow, Garrett & Dunner, LLP

(57) ABSTRACT

An internal combustion engine comprises an exhaust purification catalyst and a downstream side air-fuel ratio sensor which is arranged at a downstream side of the exhaust purification catalyst. A control system can perform fuel cut control which stops the feed of fuel to the internal combustion engine during operation of the internal combustion engine, and, after the end of fuel cut control, performs post-return rich control which sets the exhaust air-fuel ratio to a rich air-fuel ratio. The control system correct the output air-fuel ratio of the downstream side air-fuel ratio sensor, based on a difference between the stoichiometric air-fuel ratio and the output air-fuel ratio in the output stabilization time period, which is a time period when the amount of change per unit time of the output air-fuel ratio of the downstream side air-fuel ratio sensor is a predetermined value or less, in the time period after the end of the fuel cut control and before the output air-fuel ratio of the down-
(Continued)

stream side air-fuel ratio sensor becomes a rich judged air-fuel ratio or less.

11 Claims, 10 Drawing Sheets

(51) Int. Cl.
*F01N 13/00* (2010.01)
*F02D 41/24* (2006.01)
*F02D 41/14* (2006.01)

(52) U.S. Cl.
CPC ..... *F02D 41/126* (2013.01); *F02D 41/1454* (2013.01); *F02D 41/2474* (2013.01); *F01N 2560/025* (2013.01)

(58) Field of Classification Search
USPC ..... 60/274, 277
See application file for complete search history.

(56) References Cited

U.S. PATENT DOCUMENTS

2001/0040105 A1* 11/2001 Patrick ..... G01N 27/419 205/784.5
2002/0014103 A1* 2/2002 Matsubara ..... F02D 41/144 73/1.06
2002/0017467 A1* 2/2002 Ando ..... F01N 3/0842 205/781
2002/0130053 A1* 9/2002 Ando ..... F01N 3/0842 205/781
2003/0042151 A1* 3/2003 Ando ..... F01N 3/0842 205/781
2004/0040366 A1* 3/2004 Matsubara ..... F02D 41/144 73/1.06
2004/0060550 A1* 4/2004 Wu ..... F02D 41/123 123/694
2004/0098967 A1* 5/2004 Cook ..... F02D 41/1441 60/274
2006/0011180 A1* 1/2006 Sasaki ..... F01N 3/0814 123/698
2008/0245056 A1 10/2008 Kawakita et al.
2014/0075924 A1 3/2014 Aoki et al.

FOREIGN PATENT DOCUMENTS

DE 100 23 072 A1 11/2001
DE 10023072 A1 11/2001
EP 1163510 A0 12/2001
EP 2 336 532 A2 6/2011
JP 2004-176632 6/2004
JP 2008-255973 A 10/2008
JP 2009-19558 1/2009
JP 2012-57576 3/2012
JP 2012-145054 8/2012
JP 2012-241652 12/2012
WO WO 00/55614 A1 9/2000
WO WO 2012/157111 A1 11/2012

* cited by examiner

CONTROL SYSTEM OF INTERNAL COMBUSTION ENGINE

CROSS-REFERENCE TO RELATED APPLICATIONS

This application is a national phase application of International Application No. PCT/JP2015/003791, filed Jul. 28, 2015, and claims the priority of Japanese Application No. 2014-153335, filed Jul. 28, 2014, the content of both of which is incorporated herein by reference.

TECHNICAL FIELD

The present invention relates to a control system of an internal combustion engine.

BACKGROUND ART

In the past, an internal combustion engine which is provided with an exhaust purification catalyst in an exhaust passage of an internal combustion engine, and which is provided with an air-fuel ratio sensor at an upstream side, in the direction of flow of exhaust, of the exhaust purification catalyst and an electromotive force type oxygen sensor at the downstream side of the exhaust purification catalyst, has been widely known. In such a control system of an internal combustion engine, the amount of fuel fed to the internal combustion engine is controlled based on the outputs of these air-fuel ratio sensor and oxygen sensor.

However, in an electromotive force type oxygen sensor, the output for the same air-fuel ratio is different between when the air-fuel ratio of the exhaust gas around the oxygen sensor changes from an air-fuel ratio which is richer than the stoichiometric air-fuel ratio (below, "rich air-fuel ratio") to an air-fuel ratio which is leaner than the stoichiometric air-fuel ratio (below, "lean air-fuel ratio") and when it changes from a lean air-fuel ratio to a rich air-fuel ratio. Therefore, it has been proposed to use a limit current type air-fuel ratio sensor at the downstream side of the exhaust purification catalyst (for example, PTL 1).

However, even if using a downstream side air-fuel ratio sensor, sometimes deviation occurs in the output due to aging or initial variations, etc. Therefore, in the control system described in PTL 1, deviation in the downstream side air-fuel ratio sensor is corrected. Specifically, in the control system described in PTL 1, active air-fuel ratio control is performed so as to alternately switch the air-fuel ratio of the exhaust gas flowing into the exhaust purification catalyst between the rich air-fuel ratio and the lean air-fuel ratio. In addition, during this active air-fuel ratio control, the output of the air-fuel ratio sensor is corrected in accordance with the difference between the output of the downstream side air-fuel ratio sensor and the reference output which corresponds to the stoichiometric air-fuel ratio, in a predetermined time period where the output of the downstream side air-fuel ratio sensor becomes balanced. According to PTL 1, due to this, it is considered possible to correct deviation due to the degradation of the downstream side air-fuel ratio sensor, etc.

CITATION LIST

Patent Literature

PTL 1: International Publication No. 2012/157111A
PTL 2: Japanese Patent Publication No. 2004-176632A PTL 3: Japanese Patent Publication No. 2012-241652A
PTL 4: Japanese Patent Publication No. 2012-145054A
PTL 5: Japanese Patent Publication No. 2009-019558A
PTL 6: Japanese Patent Publication No. 2012-057576A

SUMMARY OF INVENTION

Technical Problem

In this regard, in the above-mentioned active air-fuel ratio control, specifically, the target air-fuel ratio of the exhaust gas flowing into the exhaust purification catalyst is controlled as explained below. That is, in the case where the target air-fuel ratio is set to the rich air-fuel ratio, the target air-fuel ratio is switched to the lean air-fuel ratio when the air-fuel ratio corresponding to the output value of the downstream side air-fuel ratio sensor (below, also referred to as "the output air-fuel ratio") becomes equal to or lower than a rich judged air-fuel ratio which is richer than the stoichiometric air-fuel ratio. Then, when the target air-fuel ratio is set to the lean air-fuel ratio, the target air-fuel ratio is switched to the rich air-fuel ratio when the output air-fuel ratio of the downstream side air-fuel ratio sensor becomes a lean judged air-fuel ratio, which is leaner than the stoichiometric air-fuel ratio, or more.

When performing such active air-fuel ratio control, sometimes the output air-fuel ratio of the downstream side air-fuel ratio sensor becomes the lean judged air-fuel ratio or more. At this time, $NO_X$, in addition to oxygen, flows out from the exhaust purification catalyst. Therefore, if performing active air-fuel ratio control, $NO_X$ flows out from the exhaust purification catalyst. Therefore, this active air-fuel ratio control is executed, for example, only at the time of diagnosis of abnormality of the exhaust purification catalyst which detects the degree of deterioration of the exhaust purification catalyst. Therefore, the frequency of execution of active air-fuel ratio control is not that great. For this reason, when correcting deviation of the downstream side air-fuel ratio sensor at the time of execution of active air-fuel ratio control, the opportunities for correcting deviation of the downstream side air-fuel ratio sensor becomes less frequent. Conversely, if increasing the frequency of correction of deviation of the downstream side air-fuel ratio sensor by increasing the frequency of execution of the active air-fuel ratio control, the amount of outflow of $NO_X$ from the exhaust purification catalyst is increased.

Further, the exhaust purification catalyst, along with use thereof, suffers from hydrocarbon (HC) poisoning or sulfur poisoning where the HC or sulfur ingredient is stored in the precious metal which is carried on the exhaust purification catalyst. In this way, if the exhaust purification catalyst suffers from HC poisoning or sulfur poisoning, the precious metal falls in activity and the maximum value of the amount of oxygen which can be stored at the exhaust purification catalyst (below, called the "maximum storable oxygen amount") is reduced.

In this regard, when the precious metal is high in activity, even if the air-fuel ratio of the exhaust gas flowing into the exhaust purification catalyst is the rich air-fuel ratio or lean air-fuel ratio, so long as the exhaust purification catalyst stores a certain extent of oxygen, the air-fuel ratio of the exhaust gas flowing out from the exhaust purification catalyst becomes substantially the stoichiometric air-fuel ratio. However, as explained above, if HC poisoning or sulfur poisoning causes the precious metal which is carried at the exhaust purification catalyst to fall in activity, the air-fuel ratio of the exhaust gas flowing out from the exhaust purification catalyst sometimes deviates from the stoichiometric air-fuel ratio. In addition, if the maximum storable oxygen amount of the exhaust purification catalyst falls, the time period from when the target air-fuel ratio is switched to the rich air-fuel ratio to when the output air-fuel ratio of the downstream side air-fuel ratio sensor becomes the rich judged air-fuel ratio or less, becomes shorter. Similarly, the time period from when the target air-fuel ratio is switched to the lean air-fuel ratio to when the output air-fuel ratio of the downstream side air-fuel ratio sensor becomes a lean judged air-fuel ratio or more, also becomes shorter. As a result, the time period during which the output air-fuel ratio of the downstream side air-fuel ratio sensor stabilizes near the stoichiometric air-fuel ratio becomes shorter, and therefore the time period during which the deviation of the output air-fuel ratio of the downstream side air-fuel ratio sensor can be detected, becomes shorter.

In addition, when performing the above-mentioned active air-fuel ratio control, the state of the exhaust purification catalyst before switching the target air-fuel ratio is not necessarily constant. For example, when deviation occurs in the output air-fuel ratio of the upstream side air-fuel ratio sensor, the air-fuel ratio of the exhaust gas flowing into the exhaust purification catalyst before switching the target air-fuel ratio becomes an air-fuel ratio different from the target air-fuel ratio. As a result, the air-fuel ratio atmosphere in the exhaust purification catalyst right before switching the target air-fuel ratio also becomes an atmosphere which is different from the target air-fuel ratio. If the state of the exhaust purification catalyst before switching the target air-fuel ratio is not constant in this way, it is confirmed that the air-fuel ratio of the exhaust gas flowing out from the exhaust purification catalyst after switching the target air-fuel ratio is affected as explained above. Therefore, if correcting the deviation based on the output air-fuel ratio of the downstream side air-fuel ratio sensor after switching the target air-fuel ratio during the active air-fuel ratio, sometimes it is not possible to suitably correct deviation of the output air-fuel ratio.

Due to the above, when correcting deviation in the output air-fuel ratio of the downstream side air-fuel ratio sensor based on the output air-fuel ratio of the downstream side air-fuel ratio sensor during execution of active air-fuel ratio control, sometimes it is not possible to suitably correct deviation of the output air-fuel ratio.

Therefore, in accordance with the above problem, an object of the present invention to provide a control system of an internal combustion engine, which can suitably correct deviation in the output air-fuel ratio of the downstream side air-fuel ratio sensor.

Solution to Problem

To solve the above problem, the following inventions are provided.

(1) A control system of an internal combustion engine, the engine comprising: an exhaust purification catalyst which is arranged in an exhaust passage of the internal combustion engine and can store oxygen; and a downstream side air-fuel ratio sensor which is arranged at the downstream side, in the direction of flow of exhaust, of the exhaust purification catalyst and which detects an air-fuel ratio of exhaust gas flowing out from the exhaust purification catalyst, wherein the control system of an internal combustion engine: can perform fuel cut control which stops the feed of fuel to the internal combustion engine during operation of the internal combustion engine; after the end of fuel cut control, performs post-return rich control which sets the air-fuel ratio of exhaust gas flowing into the exhaust purification catalyst to a rich air-fuel ratio which is richer than the stoichiometric air-fuel ratio; and correct the output air-fuel ratio of the downstream side air-fuel ratio sensor or a parameter relating to the output air-fuel ratio, based on a difference between the stoichiometric air-fuel ratio and the output air-fuel ratio in the output stabilization time period which is a time period when the amount of change per unit time of the output air-fuel ratio of the downstream side air-fuel ratio sensor is a predetermined value or less or is anticipated as becoming a predetermined value or less, in the time period after the end of the fuel cut control and before the output air-fuel ratio, which is defined as the air-fuel ratio corresponding to the output of the downstream side air-fuel ratio sensor, becomes a rich judged air-fuel ratio, which is richer than the stoichiometric air-fuel ratio, or less.

(2) The control system of an internal combustion engine according to above (1), wherein the output stabilization time period is a time period after when an elapsed time after the end of fuel cut control becomes a predetermined reference time or more.

(3) The control system of an internal combustion engine according to above (1) or (2), wherein the output stabilization time period is a time period after when a cumulative oxygen excess/deficiency after the end of the fuel cut control becomes a predetermined reference amount or more.

(4) The control system of an internal combustion engine according to any one of above (1) to (3), wherein the output stabilization time period is a time period after when a time derivative in the output air-fuel ratio of the downstream side air-fuel ratio sensor becomes a predetermined reference value or less.

(5) The control system of an internal combustion engine according to any one of claims 1 to 4, wherein the control system can perform normal control when the fuel cut control and the post-return rich control are not being performed, in the normal control, feedback control is performed so that an air-fuel ratio of exhaust gas flowing into the exhaust purification catalyst becomes a target air-fuel ratio, and the target air-fuel ratio is switched to a lean air-fuel ratio which is leaner than the stoichiometric air-fuel ratio, when the air-fuel ratio detected by the downstream side air-fuel ratio sensor becomes a rich judged air-fuel ratio or less, and is switched to a rich air-fuel ratio which is richer than the stoichiometric air-fuel ratio, when it is estimated that the oxygen storage amount of the exhaust purification catalyst from when the target air-fuel ratio is switched to the lean air-fuel ratio, becomes a predetermined switching reference storage amount, which is smaller than the maximum storable oxygen amount, or more.

(6) The control system of an internal combustion engine according to any one of above (1) to (5), wherein in the post-return rich control, in a predetermined time after the end of the fuel cut control and before the output air-fuel ratio of the downstream side air-fuel ratio sensor becomes a rich judged air-fuel ratio or less, the rich degree of the air-fuel ratio of the exhaust gas flowing into the exhaust purification catalyst is lowered.

(7) The control system of an internal combustion engine according to any one of above (1) to (6), wherein as the output air-fuel ratio of the downstream side air-fuel ratio sensor in the output stabilization time period, the average value of the output air-fuel ratio of the downstream side air-fuel ratio sensor which is detected a plurality of times during the output stabilization time period is used.

Advantageous Effects of Invention

According to the present invention, there is provided a control system of an internal combustion engine which can suitably correct deviation in the output air-fuel ratio of the downstream side air-fuel ratio sensor.

DESCRIPTION OF EMBODIMENTS

Figure 1:
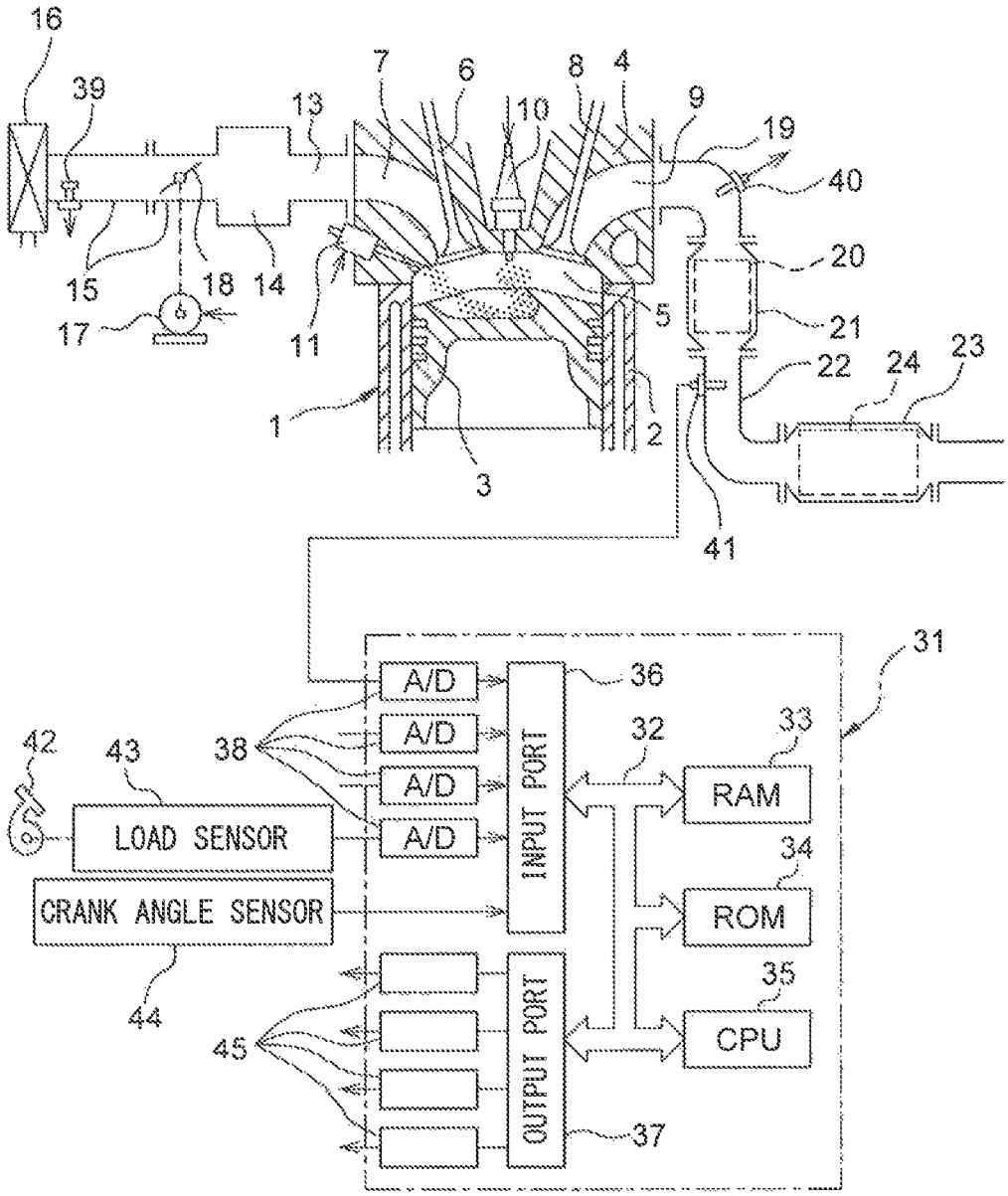
FIG. 1 is a view which schematically shows an internal combustion engine in which a control system of the present invention is used.

Below, referring to the drawings, embodiments of the present invention will be explained in detail. Note that, in the following explanation, similar components are assigned the same reference numerals.

<Explanation of Internal Combustion Engine as a Whole>

FIG. 1 is a view which schematically shows an internal combustion engine in which a control device according to the present invention is used. Referring to FIG. 1, 1 indicates an engine body, 2 a cylinder block, 3 a piston which reciprocates in the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a peripheral part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present embodiment may also use another kind of fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a collected part at which these runners are collected. The collected part of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an airflow meter 39 is arranged for detecting the flow rate of air flowing through the intake pipe 15. The output of this airflow meter 39 is input through a corresponding AD converter 38 to the input port 36. Further, at the collected part of the exhaust manifold 19, an upstream side air-fuel ratio sensor 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors 40 and 41 are also input through the corresponding AD converters 38 to the input port 36.

Further, an accelerator pedal 42 is connected to a load sensor 43 generating an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that the ECU 31 functions as a control device for controlling the internal combustion engine.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have cylinder array, state of injection of fuel, configuration of intake and exhaust systems, configuration of valve mechanism, presence of supercharger, and/or supercharged state, etc. which are different from the above internal combustion engine.

<Explanation of Exhaust Purification Catalyst>

The upstream side exhaust purification catalyst 20 and downstream side exhaust purification catalyst 24 in each case have similar configurations. The exhaust purification catalysts 20 and 24 are three-way catalysts having oxygen storage abilities. Specifically, the exhaust purification catalysts 20 and 24 are formed such that on substrate consisting of ceramic, a precious metal having a catalytic action (for example, platinum (Pt)) and a substance having an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_X$) and, in addition, an oxygen storage ability, when reaching a predetermined activation temperature.

According to the oxygen storage ability of the exhaust purification catalysts 20 and 24, the exhaust purification catalysts 20 and 24 store the oxygen in the exhaust gas when the air-fuel ratio of the exhaust gas flowing into the exhaust purification catalysts 20 and 24 is leaner than the stoichiometric air-fuel ratio (lean air-fuel ratio). On the other hand, the exhaust purification catalysts 20 and 24 release the oxygen stored in the exhaust purification catalysts 20 and 24 when the air-fuel ratio of the inflowing exhaust gas is richer than the stoichiometric air-fuel ratio (rich air-fuel ratio).

Figure 2A:
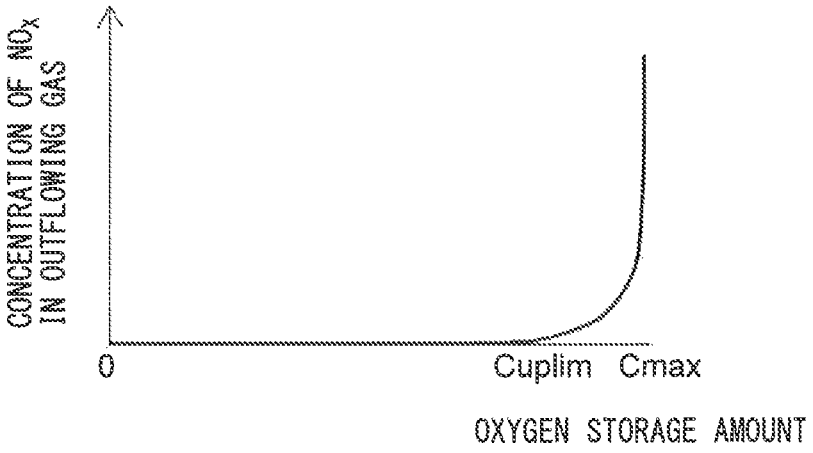
FIG. 2A is a view which shows the relationship between the oxygen storage amount of the exhaust purification catalyst and concentration of $NO_X$ in the exhaust gas flowing out from the exhaust purification catalyst.

The exhaust purification catalysts 20 and 24 have a catalytic action and oxygen storage ability and thereby have the action of purifying $NO_X$ and unburned gas according to the oxygen storage amount. That is, in the case where the air-fuel ratio of the exhaust gas flowing into the exhaust purification catalysts 20 and 24 is a lean air-fuel ratio, as shown in FIG. 2A, when the oxygen storage amount is small, the exhaust purification catalysts 20 and 24 store the oxygen in the exhaust gas. Further, along with this, the NO in the exhaust gas is reduced and purified. On the other hand, if the oxygen storage amount becomes larger beyond a certain storage amount near the maximum storable oxygen amount Cmax (in the figure, Cuplim), the exhaust gas flowing out from the exhaust purification catalysts 20 and 24 rapidly rises in concentration of oxygen and $NO_X$.

Figure 2B:
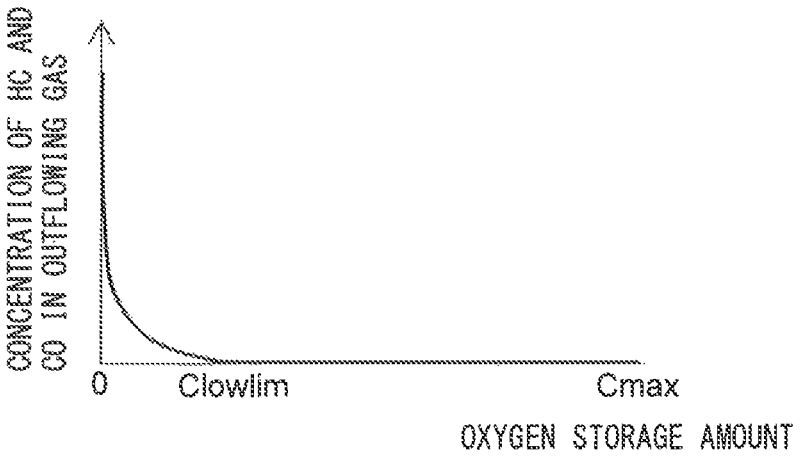
FIG. 2B is a view which shows the relationship between the oxygen storage amount of the exhaust purification catalyst and concentration of HC or CO in the exhaust gas flowing out from the exhaust purification catalyst.

On the other hand, in the case where the air-fuel ratio of the exhaust gas flowing into the exhaust purification catalysts 20 and 24 is the rich air-fuel ratio, as shown in FIG. 2B, when the oxygen storage amount is large, the oxygen stored in the exhaust purification catalysts 20 and 24 is released, and the unburned gas in the exhaust gas is oxidized and purified. On the other hand, if the oxygen storage amount becomes small, the exhaust gas flowing out from the exhaust purification catalysts 20 and 24 rapidly rises in concentration of unburned gas at a certain storage amount near zero (in the figure, Clowlim).

In the above way, according to the exhaust purification catalysts 20 and 24 used in the present embodiment, the purification characteristics of NO and unburned gas in the exhaust gas change depending on the air-fuel ratio and oxygen storage amount of the exhaust gas flowing into the exhaust purification catalysts 20 and 24. Note that, if having a catalytic action and oxygen storage ability, the exhaust purification catalysts 20 and 24 may also be catalysts different from three-way catalysts.

<Output Characteristic of Air-Fuel Ratio Sensor>

Figure 3:
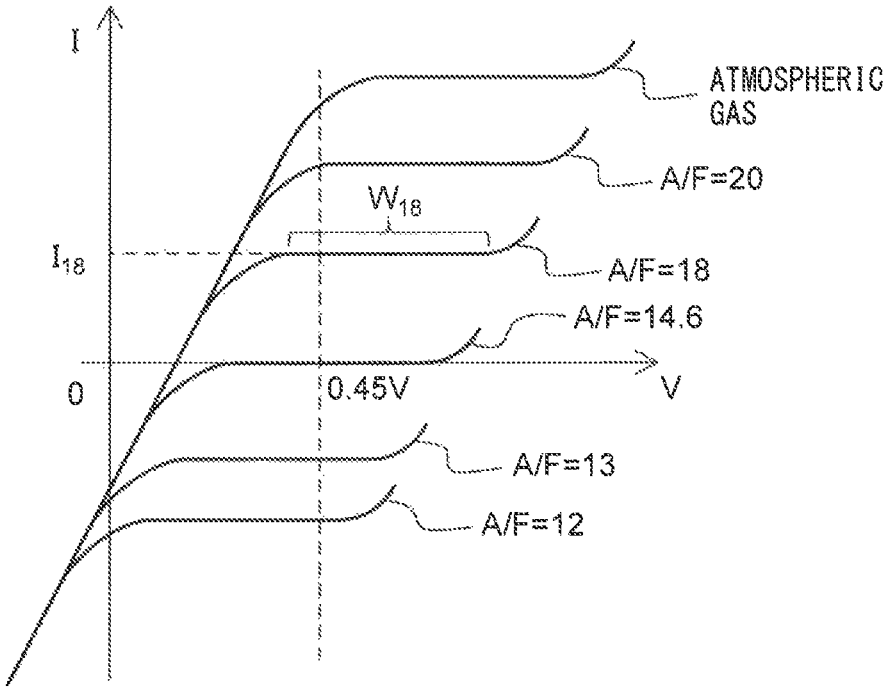
FIG. 3 is a view which shows the relationship between the voltage supplied to the sensor and output current at different exhaust air-fuel ratios.
Figure 4:
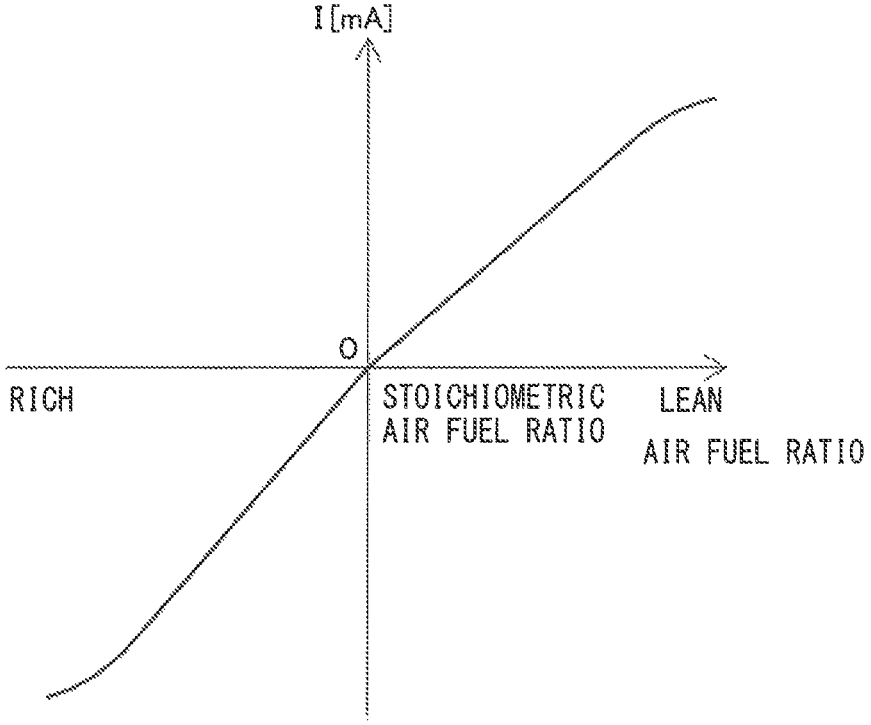
FIG. 4 is a view which shows the relationship between the exhaust air-fuel ratio and output current when making the voltage supplied to the sensor constant.

Next, referring to FIGS. 3 and 4, the output characteristic of air-fuel ratio sensors 40 and 41 in the present embodiment will be explained. FIG. 3 is a view showing the voltage-current (V-I) characteristic of the air-fuel ratio sensors 40 and 41 of the present embodiment. FIG. 4 is a view showing the relationship between air-fuel ratio of the exhaust gas (below, referred to as "exhaust air-fuel ratio") flowing around the air-fuel ratio sensors 40 and 41 and output current I, when making the supplied voltage constant. Note that, in this embodiment, the air-fuel ratio sensor having the same configurations is used as both air-fuel ratio sensors 40 and 41.

As will be understood from FIG. 3, in the air-fuel ratio sensors 40 and 41 of the present embodiment, the output current I becomes larger the higher (the leaner) the exhaust air-fuel ratio. Further, the line V-I of each exhaust air-fuel ratio has a region substantially parallel to the V axis, that is, a region where the output current does not change much at all even if the supplied voltage of the sensor changes. This voltage region is called the "limit current region". The current at this time is called the "limit current". In FIG. 3, the limit current region and limit current when the exhaust air-fuel ratio is 18 are shown by $W_{18}$ and $I_{18}$, respectively. Therefore, the air-fuel ratio sensors 40 and 41 can be referred to as "limit current type air-fuel ratio sensors".

FIG. 4 is a view which shows the relationship between the exhaust air-fuel ratio and the output current I when making the supplied voltage constant at about 0.45V. As will be understood from FIG. 4, in the air-fuel ratio sensors 40 and 41, the output current I varies linearly (proportionally) with respect to the exhaust air-fuel ratio such that the higher (that is, the leaner) the exhaust air-fuel ratio, the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes larger by a certain extent or more or when it becomes smaller by a certain extent or more, the ratio of change of the output current to the change of the exhaust air-fuel ratio becomes smaller.

Note that, in the above example, as the air-fuel ratio sensors 40 and 41, limit current type air-fuel ratio sensors are used. However, as the air-fuel ratio sensors 40 and 41, it is also possible to use air-fuel ratio sensor not a limit current type or any other air-fuel ratio sensor, as long as the output current varies linearly with respect to the exhaust air-fuel ratio. Further, the air-fuel ratio sensors 40 and 41 may have structures different from each other.

<Basic Air Fuel Ratio Control>

Next, an outline of the basic air-fuel ratio control in a control device of an internal combustion engine of the present embodiment will be explained. In the air-fuel ratio control of the present embodiment, the fuel feed amount from the fuel injectors 11 is controlled by feedback based on the output air-fuel ratio of the upstream side air-fuel ratio sensor 40 so that the output air-fuel ratio of the upstream side air-fuel ratio sensor 40 becomes the target air-fuel ratio. Note that, "output air-fuel ratio" means an air-fuel ratio corresponding to the output value of an air-fuel ratio sensor.

On the other hand, in the air-fuel ratio control of the present embodiment, a target air-fuel ratio setting control for setting the target air-fuel ratio is performed based on the output air-fuel ratio of the downstream side air-fuel ratio sensor 41, etc. In the target air-fuel ratio setting control, when the output air-fuel ratio of the downstream side air-fuel ratio sensor 41 becomes the rich air-fuel ratio, the target air-fuel ratio is set to the lean set air-fuel ratio. Then, it is maintained at this air-fuel ratio. Further, the lean set air-fuel ratio is a predetermined air-fuel ratio which is leaner by a certain extent than the stoichiometric air-fuel ratio (an air-fuel ratio serving as the center of control). For example, it is 14.65 to 20, preferably 14.65 to 18, more preferably 14.65 to 16 or so. Further, the lean set air-fuel ratio can be expressed as an air-fuel ratio obtained by adding the lean correction amount to the air-fuel ratio serving as the center of control (in the present embodiment, stoichiometric air-fuel ratio). Further, in the present embodiment, it is judged that the output air-fuel ratio of the downstream side air-fuel ratio sensor 41 becomes the rich air-fuel ratio, when the output air-fuel ratio of the downstream side air-fuel ratio sensor 41 becomes a rich judgement air-fuel ratio which is slightly richer than the stoichiometric air-fuel ratio (for example, 14.55) or less.

If the target air-fuel ratio is changed to the lean set air-fuel ratio, the oxygen excess/deficiency of the exhaust gas flowing into the upstream side exhaust purification catalyst 20 is cumulatively added. The "oxygen excess/deficiency" means the amount of oxygen which becomes excessive or the amount of oxygen which becomes deficient (amount of excess unburned gas, etc.) when trying to make the air-fuel ratio of the exhaust gas flowing into the upstream side exhaust purification catalyst 20 the stoichiometric air-fuel ratio. In particular, when the target air-fuel ratio is the lean set air-fuel ratio, the exhaust gas flowing into the upstream side exhaust purification catalyst 20 becomes excessive in oxygen. This excess oxygen is stored in the upstream side exhaust purification catalyst 20. Therefore, the cumulative value of the oxygen excess/deficiency (below, also referred to as the "cumulative oxygen excess/deficiency") can be said to be an estimated value of the oxygen storage amount OSA of the upstream side exhaust purification catalyst 20.

Note that, the oxygen excess/deficiency is calculated based on the output air-fuel ratio of the upstream side air-fuel ratio sensor 40 and the estimated value of the intake air amount to the inside of the combustion chamber 5 which is calculated based on the output of the airflow meter 39 etc. or the fuel feed amount of the fuel injector 11 etc. Specifically, the oxygen excess/deficiency OED is, for example, calculated by the following formula (1):

$$OED=0.23*Qi*(AFup-AFR) \quad (1)$$

where 0.23 indicates the concentration of oxygen in the air, Qi indicates the amount of fuel injection, and AFup indicates the output air-fuel ratio of the upstream side air-fuel ratio sensor 40 and AFR indicates the air-fuel ratio serving as the center of control (in the present embodiment, stoichiometric air-fuel ratio).

If the cumulative oxygen excess/deficiency which is cumulative value of the thus calculated oxygen excess/deficiency becomes the predetermined switching reference value (corresponding to predetermined switching reference storage amount Cref) or more, the target air-fuel ratio which had up to then been set to the lean set air-fuel ratio is set to the rich set air-fuel ratio, then is maintained at this air-fuel ratio. The rich set air-fuel ratio is a predetermined air-fuel ratio which is a certain degree richer than the stoichiometric air-fuel ratio (air-fuel ratio serving as the center of control). For example, it is 12 to 14.58, preferably 13 to 14.57, more preferably 14 to 14.55 or so. Further, the rich set air-fuel ratio can be expressed as an air-fuel ratio obtained by subtracting the rich correction amount from the air-fuel ratio serving as the center of control (in the present embodiment, stoichiometric air-fuel ratio). Note that, in the present embodiment, the difference between the rich set air-fuel ratio and the stoichiometric air-fuel ratio (rich degree) is the difference between the lean set air-fuel ratio and the stoichiometric air-fuel ratio (lean degree) or less.

Then, when the output air-fuel ratio of the downstream side air-fuel ratio sensor 41 again becomes the rich judgment air-fuel ratio or less, the target air-fuel ratio is again set to the lean set air-fuel ratio. Then, a similar operation is repeated. In this way, in the present embodiment, the target air-fuel ratio of the exhaust gas flowing into the upstream side exhaust purification catalyst 20 is alternately set to the lean set air-fuel ratio and the rich set air-fuel ratio.

However, even if performing the control stated above, the actual oxygen storage amount of the upstream side exhaust purification catalyst 20 may reach the maximum storable oxygen amount before the cumulative oxygen excess/deficiency reaches the switching reference value. As a reason for it, the reduction of the maximum storable oxygen amount of the upstream side exhaust purification catalyst 20 or significant temporal changes in the air-fuel ratio of the exhaust gas flowing into the upstream side exhaust purification catalyst 20 can be considered. If the oxygen storage amount reaches the maximum storable oxygen amount as such, the exhaust gas of lean air-fuel ratio flows out from the upstream side exhaust purification catalyst 20. Therefore, in the present embodiment, when the output air-fuel ratio of the downstream side air-fuel ratio sensor 41 becomes lean air-fuel ratio, the target air-fuel ratio is switched to the rich set air-fuel ratio. In particular, in the present embodiment, when the output air-fuel ratio of the downstream side air-fuel ratio sensor 41 becomes a lean judgment air-fuel ratio which is slightly leaner than the stoichiometric air-fuel ratio (for example, 14.65), it is judged that the output air-fuel ratio of the downstream side air-fuel sensor 41 becomes a lean air-fuel ratio.

<Explanation of Air Fuel Ratio Control Using Time Chart>

Figure 5:
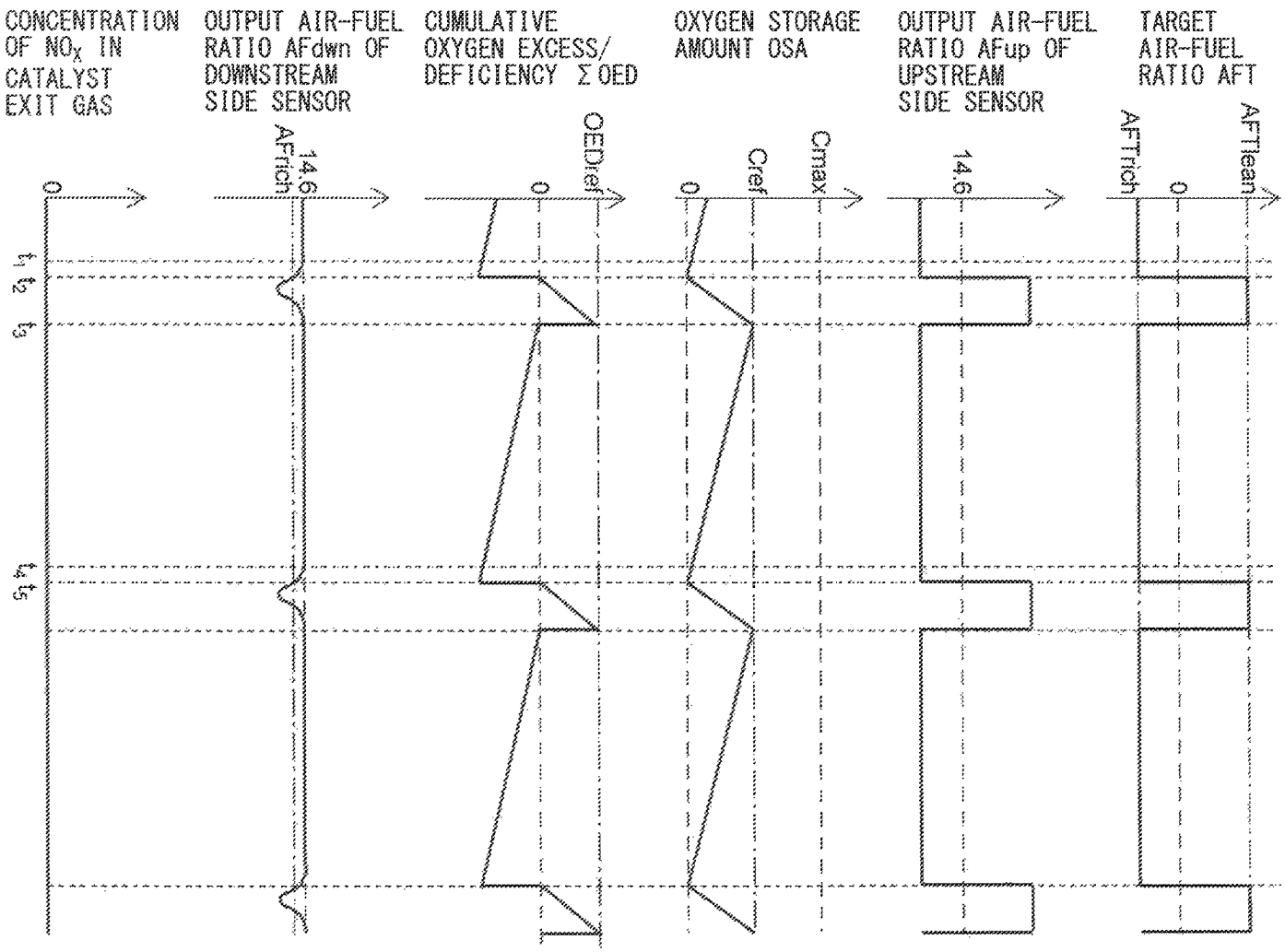
FIG. 5 is a time chart of an air-fuel ratio adjustment amount, etc., when performing an air-fuel ratio control.
Figure 6:
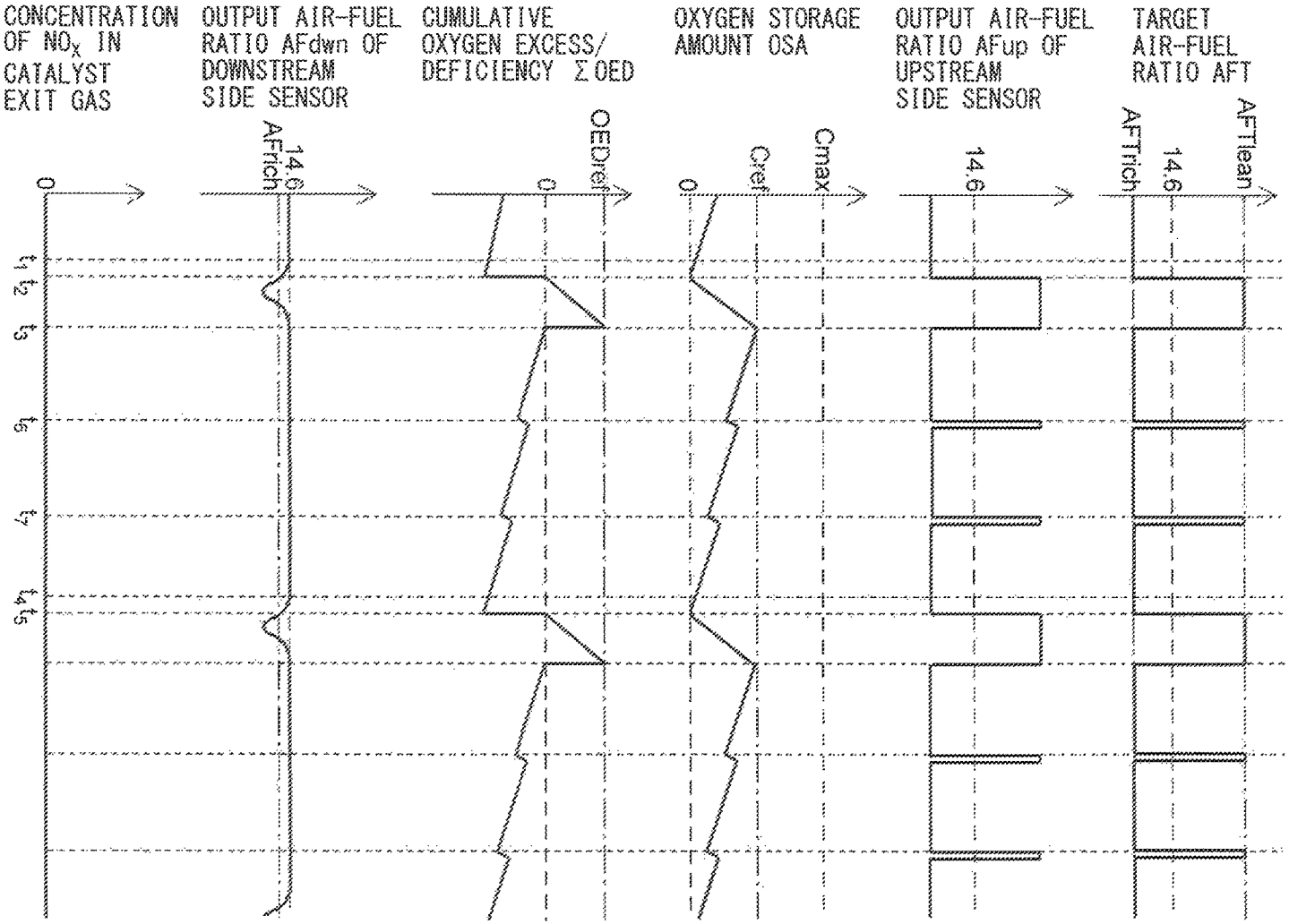
FIG. 6 is a time chart of an air-fuel ratio adjustment amount, etc., when performing an air-fuel ratio control.

Referring to FIG. 5, the operation explained as above will be explained in detail. FIG. 5 is a time chart of the target air-fuel ratio AFT, the output air-fuel ratio AFup of the upstream side air-fuel ratio sensor 40, the oxygen storage amount OSA of the upstream side exhaust purification catalyst 20, the cumulative oxygen excess/deficiency ΣOED, the output air-fuel ratio AFdwn of the downstream side air-fuel ratio sensor 41, and the concentration of $NO_X$ in the exhaust gas flowing out from the upstream side exhaust purification catalyst 20, when performing the air-fuel ratio control of the present embodiment.

In the illustrated example, in the state before the time $t_1$, the target air-fuel ratio AFT is set to the rich set air-fuel ratio AFTrich. Along with this, the output air-fuel ratio of the upstream side air-fuel ratio sensor 40 becomes a rich air-fuel ratio. Unburned gas contained in the exhaust gas flowing into the upstream side exhaust purification catalyst 20 is purified by the upstream side exhaust purification catalyst 20, and along with this the upstream side exhaust purification catalyst 20 is gradually decreased in the oxygen storage amount OSA. Therefore, the cumulative oxygen excess/deficiency ΣOED is also gradually decreased. The unburned gas is not contained in the exhaust gas flowing out from the upstream side exhaust purification catalyst 20 by the purification at the upstream side exhaust purification catalyst 20, and therefore the output air-fuel ratio AFdwn of the downstream side air-fuel ratio sensor 41 becomes substantially stoichiometric air-fuel ratio. Further, since the air-fuel ratio of the exhaust gas flowing into the upstream side exhaust purification catalyst 20 becomes the rich air-fuel ratio, the amount of $NO_X$ exhausted from the upstream side exhaust purification catalyst 20 becomes substantially zero.

If the upstream side exhaust purification catalyst 20 gradually decreases in oxygen storage amount OSA, the oxygen storage amount OSA approaches zero at the time $t_1$. Along with this, part of the unburned gas flowing into the upstream side exhaust purification catalyst 20 starts to flow out without being purified by the upstream side exhaust purification catalyst 20. Due to this, after the time $t_1$, the output air-fuel ratio AFdwn of the downstream side air-fuel ratio sensor 41 gradually falls. As a result, at the time $t_2$, the output air-fuel ratio AFdwn of the downstream side air-fuel ratio sensor 41 reaches the rich judgment air-fuel ratio AFrich.

In the present embodiment, when the output air-fuel ratio AFdwn of the downstream side air-fuel ratio sensor 41 becomes the rich judgment air-fuel ratio AFrich or less, to increase the oxygen storage amount OSA, the target air-fuel ratio AFT is switched to the lean set air-fuel ratio AFTlean. Further, at this time, the cumulative oxygen excess/deficiency ΣOED is reset to 0.

Note that, in the present embodiment, the target air-fuel ratio AFT is switched after the output air-fuel ratio of the downstream side air-fuel ratio sensor 41 reaches the rich judgment air-fuel ratio. This is because even if the oxygen storage amount of the upstream side exhaust purification catalyst 20 is sufficient, the air-fuel ratio of the exhaust gas flowing out from the upstream side exhaust purification catalyst 20 is sometimes slightly offset from the stoichiometric air-fuel ratio. Conversely speaking, the rich judgment air-fuel ratio is set to an air-fuel ratio which the air-fuel ratio of the exhaust gas flowing out from the upstream side exhaust purification catalyst 20 will never reach when the oxygen storage amount of the upstream side exhaust purification catalyst 20 is sufficient.

When the target air-fuel ratio is switched to a lean air-fuel ratio at the time $t_2$, the air-fuel ratio of the exhaust gas flowing into the upstream side exhaust purification catalyst 20 changes from the rich air-fuel ratio to the lean air-fuel ratio. Further, along with this, the output air-fuel ratio AFup of the upstream side air-fuel ratio sensor 40 becomes a lean air-fuel ratio (in actuality, a delay occurs from when the target air-fuel ratio is switched to when the air-fuel ratio of the exhaust gas flowing into the upstream side exhaust purification catalyst 20 changes, but in the illustrated example, it is deemed for convenience that the change is simultaneous). If at the time $t_2$ the air-fuel ratio of the exhaust gas flowing into the upstream side exhaust purification catalyst 20 changes to the lean air-fuel ratio, the upstream side exhaust purification catalyst 20 increases in the oxygen storage amount OSA. Further, along with this, the cumulative oxygen excess/deficiency ΣOED also gradually increases.

Due to this, the air-fuel ratio of the exhaust gas flowing out from the upstream side exhaust purification catalyst 20 changes to the stoichiometric air-fuel ratio, and the output air-fuel ratio AFdwn of the downstream side air-fuel ratio sensor 41 converges to the stoichiometric air-fuel ratio. At this time, the air-fuel ratio of the exhaust gas flowing into the upstream side exhaust purification catalyst 20 becomes the lean air-fuel ratio, but there is sufficient leeway in the oxygen storage ability of the upstream side exhaust purification catalyst 20, and therefore the oxygen in the inflowing exhaust gas is stored in the upstream side exhaust purification catalyst 20 and the $NO_X$ is reduced and purified. Therefore, the exhaust amount of $NO_X$ from the upstream side exhaust purification catalyst 20 becomes substantially zero.

Then, if the upstream side exhaust purification catalyst 20 increases in oxygen storage amount OSA, at the time $t_3$, the oxygen storage amount OSA of the upstream side exhaust purification catalyst 20 reaches the switching reference storage amount Cref. For this reason, the cumulative oxygen excess/deficiency ΣOED reaches the switching reference value OEDref which corresponds to the switching reference storage amount Cref. In the present embodiment, if the cumulative oxygen excess/deficiency TOED becomes the switching reference value OEDref or more, in order to suspend the storage of oxygen to the upstream side exhaust purification catalyst 20, the target air-fuel ratio AFT is switched to the rich set air-fuel ratio AFTrich. Further, at this time, the cumulative oxygen excess/deficiency ΣOED is reset to 0.

In the example which is shown in FIG. 5, the oxygen storage amount OSA falls simultaneously with the target air-fuel ratio being switched at the time $t_3$, but in actuality, a delay occurs from when the target air-fuel ratio is switched to when the oxygen storage amount OSA falls. Further, the air-fuel ratio of the exhaust gas flowing into the upstream side exhaust purification catalyst 20 is sometimes unintentionally significantly shifted, for example, in the case where engine load becomes high by accelerating a vehicle provided with the internal combustion engine and thus the air intake amount is instantaneously significantly shifted.

As opposed to this, the switching reference storage amount Cref is set sufficiently lower than the maximum storable oxygen amount Cmax when the upstream exhaust purification catalyst 20 is new. For this reason, even if such a delay occurs, or even if the air-fuel ratio is unintentionally and instantaneously shifted from the target air-fuel ratio, the oxygen storage amount OSA does not reach the maximum storable oxygen amount Cmax. Conversely, the switching reference storage amount Cref is set to an amount sufficiently small so that the oxygen storage amount OSA does not reach the maximum storable oxygen amount Cmax even if a delay or unintentional shift in air-fuel ratio occurs. For example, the switching reference storage amount Cref is ¾ or less of the maximum storable oxygen amount Cmax when the upstream side exhaust purification catalyst 20 is new, preferably ½ or less, more preferably ⅓ or less. As a result, the target air-fuel ratio AFT is switched to the rich set air-fuel ratio AFTrich before the output air-fuel ratio AFdwn of the downstream side air-fuel ratio sensor 41 reaches the lean judged air-fuel ratio AFlean.

If the target air-fuel ratio is switched to a rich air-fuel ratio at the time $t_3$, the air-fuel ratio of the exhaust gas flowing into the upstream side exhaust purification catalyst 20 changes from the lean air-fuel ratio to the rich air-fuel ratio. Along with this, the output air-fuel ratio AFup of the upstream side air-fuel ratio sensor 40 becomes a rich air-fuel ratio (in actuality, a delay occurs from when the target air-fuel ratio is switched to when the exhaust gas flowing into the upstream side exhaust purification catalyst 20 changes in air-fuel ratio, but in the illustrated example, it is deemed for convenience that the change is simultaneous). The exhaust gas flowing into the upstream side exhaust purification catalyst 20 contains unburned gas, and therefore the upstream side exhaust purification catalyst 20 gradually decreases in oxygen storage amount OSA. At the time $t_4$, in the same way as the time $t_1$, the output air-fuel ratio AFdwn of the downstream side air-fuel ratio sensor 41 starts to fall. At this time as well, the air-fuel ratio of the exhaust gas flowing into the upstream side exhaust purification catalyst 20 is the rich air-fuel ratio, and therefore $NO_X$ exhausted from the upstream side exhaust purification catalyst 20 is substantially zero.

Next, at the time $t_5$, in the same way as time $t_2$, the output air-fuel ratio AFdwn of the downstream side air-fuel ratio sensor 41 reaches the rich judgment air-fuel ratio AFrich. Due to this, the target air-fuel ratio AFT is switched to the lean set air-fuel ratio. After this, the cycle of the above mentioned times $t_1$ to $t_5$ is repeated.

As will be understood from the above explanation, according to the present embodiment, it is possible to constantly suppress the amount of $NO_X$ exhausted from the upstream side exhaust purification catalyst 20. That is, as long as performing the control explained above, the exhaust amount of $NO_X$ from the upstream side exhaust purification catalyst 20 can basically be zero. Further, since the cumulative period for calculating the cumulative oxygen excess/deficiency ΣOED is short, comparing with the case where the cumulative period is long, a possibility of error occurring is low. Therefore, it is suppressed that $NO_X$ is exhausted from the upstream side exhaust purification catalyst 20 due to the calculation error in the cumulative oxygen excess/deficiency ΣOED.

Further, in general, if the oxygen storage amount of the exhaust purification catalyst is maintained constant, the exhaust purification catalyst falls in oxygen storage ability. That is, it is necessary that the oxygen storage amount of the exhaust purification catalyst is varied in order to maintain the oxygen storage ability of the exhaust purification catalyst high. On the other hand, according to the present embodiment, as shown in FIG. 5, the oxygen storage amount OSA of the upstream side exhaust purification catalyst 20 constantly fluctuates up and down, and therefore the oxygen storage ability is kept from falling.

Note that, in the above embodiment, the target air-fuel ratio AFT is maintained to the lean set air-fuel ratio AFTlean in the time $t_2$ to $t_3$. However, in this period, the target air-fuel ratio AFT is not necessarily maintained constant, and can be set so as to vary, for example to be gradually reduced. Alternatively, in the period from the time $t_2$ to time $t_3$, the target air-fuel ratio AFT may be temporally set to a value lower than the stoichiometric air-fuel ratio (for example, the rich set air-fuel ratio, etc.).

Similarly, in the above embodiment, the target air-fuel ratio AFT is maintained to the rich set air-fuel ratio AFTrich in the time $t_3$ to $t_5$. However, in this period, the target air-fuel ratio AFT is not necessarily maintained constant, and can be set so as to vary, for example to be gradually increased. Alternatively, in the period from the time $t_3$ to time $t_5$, the target air-fuel ratio AFT may be temporally set to a value higher than the stoichiometric air-fuel ratio (for example, the lean set air-fuel ratio, etc.).

However, even in this case, the target air-fuel ratio AFT in the time $t_2$ to $t_3$ is set so that the difference between the average value of the target air-fuel ratio in the time $t_2$ to $t_3$ and the stoichiometric air-fuel ratio is larger than the difference between the average value of the target air-fuel ratio in the time $t_3$ to $t_5$ and the stoichiometric air-fuel ratio.

Note that, in the present embodiment, setting of the target air-fuel ratio, is performed by the ECU 31. Therefore, it can be said that when the air-fuel ratio of the exhaust gas detected by the downstream side air-fuel ratio sensor 41 becomes the rich judgment air-fuel ratio or less, the ECU 31 sets the target air-fuel ratio of the exhaust gas flowing into the upstream side exhaust purification catalyst 20 to the lean air-fuel ratio continuously or intermittently until the oxygen storage amount OSA of the upstream side exhaust purification catalyst 20 is estimated to be the switching reference storage amount Cref or more, and when the oxygen storage amount OSA of the upstream side exhaust purification catalyst 20 is estimated to be the switching reference storage amount Cref or more, the ECU 31 sets the target air-fuel ratio to the rich air-fuel ratio continuously or intermittently until the air-fuel ratio of the exhaust gas detected by the downstream side air-fuel ratio sensor 41 becomes the rich judgment air-fuel ratio or less without the oxygen storage amount OSA reaching the maximum storable oxygen amount Cmaxn.

More simply speaking, in the present embodiment, it can be said that the ECU 31 switches the target air-fuel ratio to the lean air-fuel ratio when the air-fuel ratio detected by the downstream side air-fuel ratio sensor 41 becomes the rich judgment air-fuel ratio or less and switches the target air-fuel ratio to the rich air-fuel ratio when the oxygen storage amount OSA of the upstream side exhaust purification catalyst 20 becomes the switching reference storage amount Cref or more.

Further, in the above embodiment, the cumulative oxygen excess/deficiency ΣOED is calculated, based on the output air-fuel ratio AFup of the upstream air-fuel ratio sensor 40 and the estimated value of the air intake amount to the combustion chamber 6, etc. However, the oxygen storage amount OSA may also be calculated based on parameters other than these parameters and may be estimated based on parameters which are different from these parameters. Further, in the above embodiment, if the cumulative oxygen excess/deficiency ΣOED becomes the switching reference value OEDref or more, the target air-fuel ratio is switched from the lean set air-fuel ratio to the rich set air-fuel ratio. However, the timing of switching the target air-fuel ratio from the lean set air-fuel ratio to the rich set air-fuel ratio may, for example, also be based on the engine operating time from when switching the target air-fuel ratio from the rich set air-fuel ratio to the lean set air-fuel ratio or other parameter. However, even in this case, the target air-fuel ratio has to be switched from the lean set air-fuel ratio to the rich set air-fuel ratio while the oxygen storage amount OSA of the upstream side exhaust purification catalyst 20 is estimated to be smaller than the maximum storable oxygen amount.

<Fuel Cut Control>

Further, in the internal combustion engine of the present embodiment, at the time of deceleration of a vehicle which mounts an internal combustion engine, etc., fuel cut control is performed which stops or greatly decreases the injection of fuel from a fuel injector during operation of the internal combustion engine so as to stop or greatly reduce the feed of fuel to a combustion chamber 5. This fuel cut control is started when a given fuel cut start condition stands. Specifically, fuel cut control is, for example, performed when the amount of depression of the accelerator pedal 42 is zero or substantially zero (that is, the engine load is zero or substantially zero) and the engine speed is a predetermined speed, which is higher than the speed during idling, or more.

When fuel cut control is performed, air or exhaust gas similar to air is exhausted from the internal combustion engine, and therefore gas with an extremely high air-fuel ratio (that is, extremely high lean degree) flows into the upstream side exhaust purification catalyst 20. As a result, during fuel cut control, a large amount of oxygen flows into the upstream side exhaust purification catalyst 20 and the oxygen storage amount of the upstream side exhaust purification catalyst 20 reaches the maximum storable oxygen amount.

Further, fuel cut control is made to end when a given fuel cut end condition stands. As the fuel cut end condition, for example, the amount of depression of the accelerator pedal 42 becoming a given value or more (that is, the engine load becoming a certain extent of value), the engine speed becoming a given speed, which is higher than the speed at the time of idling, or less, etc., may be mentioned. Further, in the internal combustion engine of the present embodiment, right after end of fuel cut control, post-return rich control is performed which sets the air-fuel ratio of the exhaust gas flowing into the upstream side exhaust purification catalyst 20 to a post-return rich set air-fuel ratio which is richer than the rich set air-fuel ratio. Accordingly, during fuel cut control, it is possible to make the upstream side exhaust purification catalyst 20 quickly release the stored oxygen.

<Deviation in Downstream Side Air-Fuel Ratio Sensor>

In this regard, in the air-fuel ratio sensors 40 and 41, aging or initial manufacturing variations, etc., sometimes cause deviation to occur in their output air-fuel ratios. Therefore, for example, when the air-fuel ratio of the exhaust gas around the downstream side air-fuel ratio sensor 41 is an air-fuel ratio which is different from the stoichiometric air-fuel ratio, the output air-fuel ratio AFdwn of the downstream side air-fuel ratio sensor 41 sometimes becomes the stoichiometric air-fuel ratio. In this case, when the output air-fuel ratio AFdwn of the downstream side air-fuel ratio sensor 41 is the stoichiometric air-fuel ratio, the air-fuel ratio of the exhaust gas around the downstream side air-fuel ratio sensor 41 is an air-fuel ratio which is different from the stoichiometric air-fuel ratio. When performing such an air-fuel ratio control, if such deviation occurs in the output air-fuel ratio AFdwn of the downstream side air-fuel ratio sensor 41, the amount of outflow of unburned gas or $NO_X$ from the upstream side exhaust purification catalyst 20 increases.

Figure 7A:
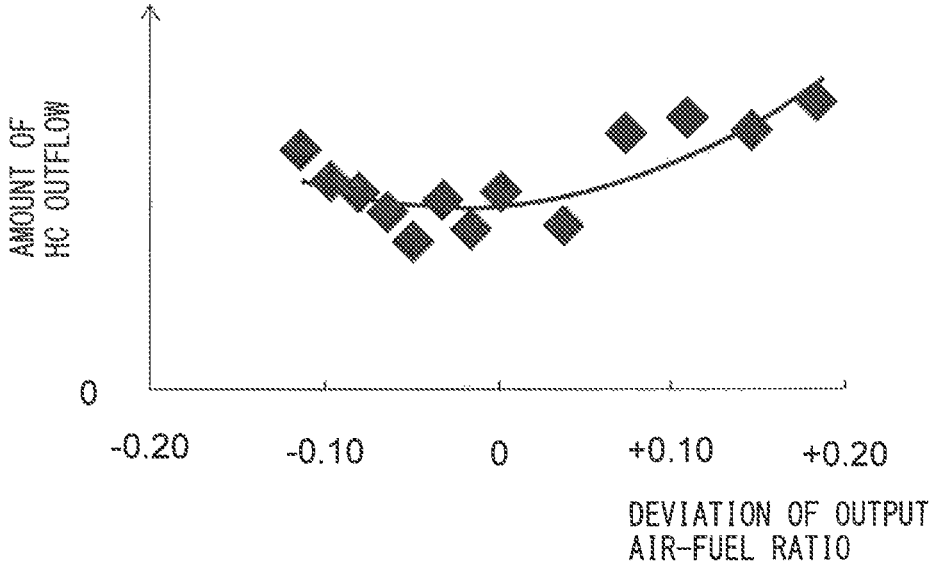
FIG. 7A is a view which shows a relationship between a deviation of an output air-fuel ratio at a downstream side air-fuel ratio sensor and the amount of outflow of unburned HC per unit operation time.
Figure 7B:
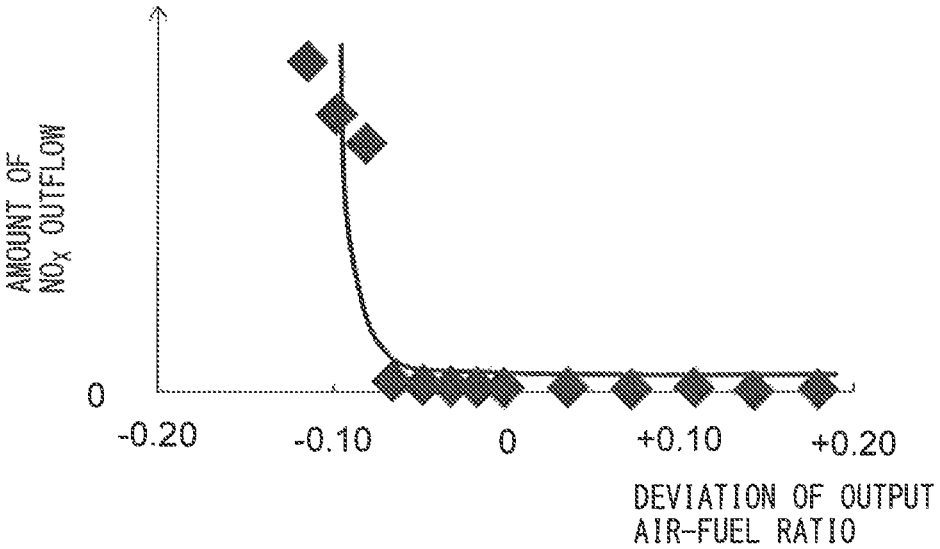
FIG. 7B is a view which shows a relationship between a deviation of an output air-fuel ratio at a downstream side air-fuel ratio sensor and the amount of outflow of $NO_X$ per unit operation time.

FIGS. 7A and 7B are views which show the relationship between the deviation of the output air-fuel ratio at the downstream side air-fuel ratio sensor 41 and the amount of outflow of unburned HC or $NO_X$ per unit operation time. The deviation of the output air-fuel ratio of FIGS. 7A and 7B shows the amount of deviation when the output air-fuel ratio of the downstream side air-fuel ratio sensor 41 deviates so as to shift overall from the actual air-fuel ratio of the exhaust gas around the downstream side air-fuel ratio sensor 41. Therefore, the case where the deviation of the output air-fuel ratio is 0 in FIGS. 7A and 7B indicates the case where, if the actual air-fuel ratio of the exhaust gas around the downstream side air-fuel ratio sensor 41 is the stoichiometric air-fuel ratio, the output air-fuel ratio of the downstream side air-fuel ratio sensor 41 is also the stoichiometric air-fuel ratio. On the other hand, the case where the deviation of the output air-fuel ratio is −0.10, indicates the case where, if the actual air-fuel ratio of the surroundings becomes the stoichiometric air-fuel ratio, the output air-fuel ratio of the downstream side air-fuel ratio sensor 41 becomes a value lower by 0.10 than the stoichiometric air-fuel ratio (when stoichiometric air-fuel ratio is 14.60, 14.50). That is, it shows the case when the output air-fuel ratio deviates to the rich side. Conversely, the case where the deviation of the output air-fuel ratio is 0.10, indicates the case where, if the actual air-fuel ratio of the surroundings is the stoichiometric air-fuel ratio, the output air-fuel ratio of the downstream side air-fuel ratio sensor 41 is a value higher by 0.10 than the stoichiometric air-fuel ratio (when stoichiometric air-fuel ratio is 14.60, 14.70). That is, it shows the case where the output air-fuel ratio deviates to the lean side.

As will be understood from FIG. 7A, the amount of outflow of unburned HC from the upstream side exhaust purification catalyst 20 is smallest when the amount of deviation at the output air-fuel ratio of the downstream side air-fuel ratio sensor 41 is 0. Further, when the output air-fuel ratio of the downstream side air-fuel ratio sensor 41 deviates to either side of the rich side and lean side, the amount of outflow of unburned HC increases as the amount of deviation becomes greater. Further, as will be understood from FIG. 7B, the amount of outflow of $NO_X$ from the upstream side exhaust purification catalyst 20 is small when the amount of deviation at the output air-fuel ratio of the downstream side air-fuel ratio sensor 41 is 0 or deviates to the lean side. However, when the output air-fuel ratio of the downstream side air-fuel ratio sensor 41 deviates to the rich side by a certain constant value or more, the amount of outflow of $NO_X$ rapidly increases as the amount of deviation becomes greater.

In this way, if deviation occurs in the output air-fuel ratio of the downstream side air-fuel ratio sensor 41, the amount of outflow of unburned gas or $NO_X$ from the upstream side exhaust purification catalyst 20 increases. Therefore, it is necessary to suitably detect the deviation in the output air-fuel ratio of the downstream side air-fuel ratio sensor 41, and compensate for deviation of the output air-fuel ratio of the downstream side air-fuel ratio sensor 41 based on the detected deviation.

<Correction of Deviation in Air-Fuel Ratio Sensor>

Therefore, in the present embodiment, when the output air-fuel ratio of the downstream side air-fuel ratio sensor 41 converges to a certain value after the end of the fuel cut control which stops the feed of fuel to the combustion chamber 5 during operation of the internal combustion engine, deviation in the output air-fuel ratio of the downstream side air-fuel ratio sensor 41 is compensated based on the converged value.

Figure 8:
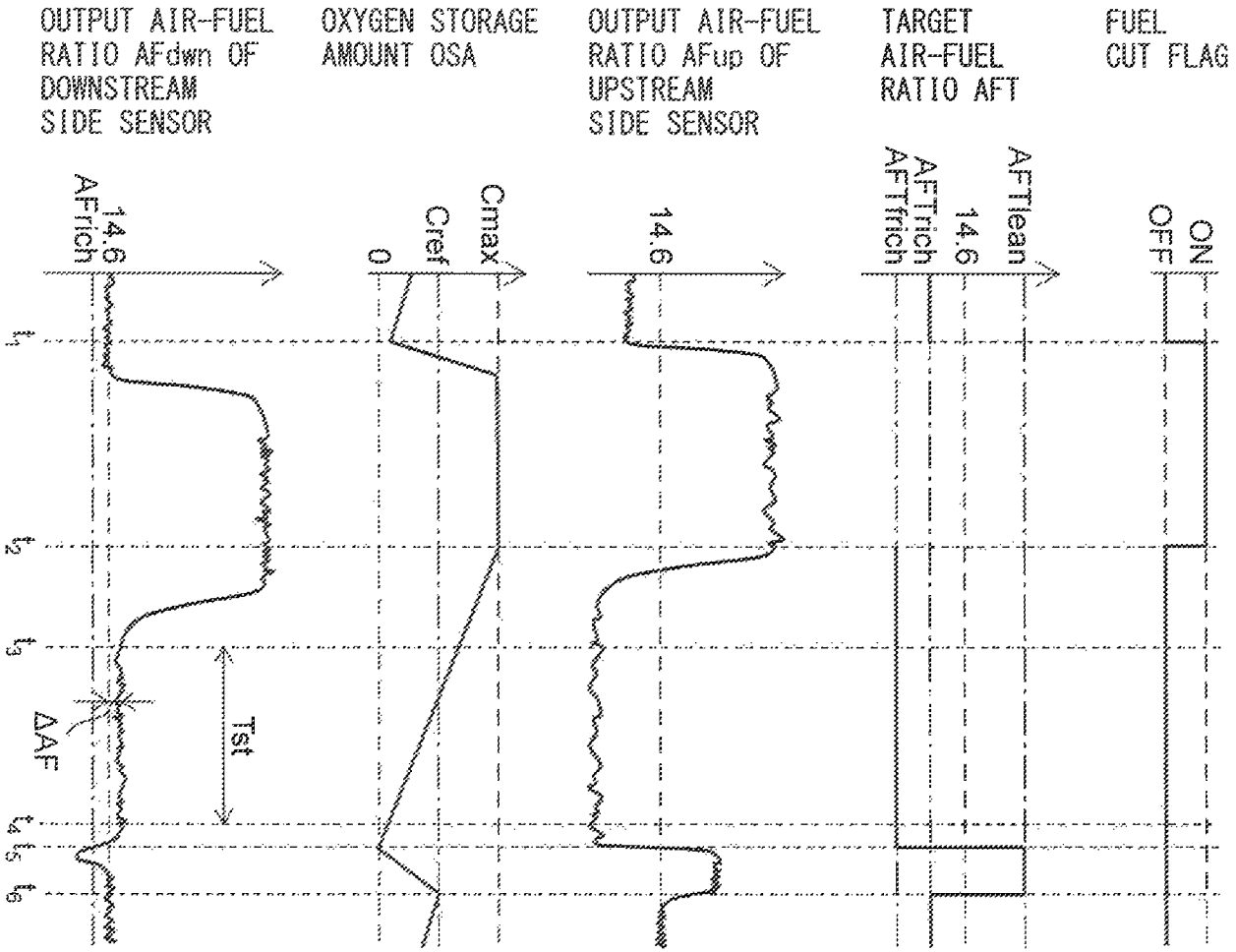
FIG. 8 is a time chart of a target air-fuel ratio, etc., at the time of execution of fuel cut control.

FIG. 8 is a time chart of the target air-fuel ratio AFT, etc., when executing fuel cut control. In the example shown in FIG. 8, fuel cut control is started at the time $t_1$ (FC flag on) and fuel cut control is ended at the time $t_2$. Further, at the time $t_2$ when fuel cut control is ended, post-return rich control is started and, at the time $t_3$, post-return rich control is ended and the above-mentioned normal air-fuel ratio control is started.

In the example shown in FIG. 8, if fuel cut control is started at the time $t_1$, air flows out from the combustion chamber 5 of the internal combustion engine, and therefore the output air-fuel ratio AFup of the upstream side air-fuel ratio sensor 40 rapidly rises. Further, the oxygen storage amount OSA of the upstream side exhaust purification catalyst 20 also rapidly increases.

If the oxygen storage amount OSA of the upstream side exhaust purification catalyst 20 reaches the maximum storable oxygen amount Cmax, the oxygen flowing into the upstream side exhaust purification catalyst 20 flows out as is from the upstream side exhaust purification catalyst 20. Therefore, the output air-fuel ratio AFdwn of the downstream side air-fuel ratio sensor 41 also rapidly rises along with a certain amount of delay from the start of fuel cut control.

Then, if, at the time $t_2$, fuel cut control is ended, post-return rich control is started. In post-return rich control, the target air-fuel ratio AFT is set to the post-return rich set air-fuel ratio AFTfrich. Along with this, the output air-fuel ratio AFup of the upstream side air-fuel ratio sensor 40 becomes the rich air-fuel ratio (corresponding to post-return rich set air-fuel ratio). Further, the air-fuel ratio of the exhaust gas flowing into the upstream side exhaust purification catalyst 20 also becomes a rich air-fuel ratio with a large rich degree, and therefore the oxygen storage amount OSA of the upstream side exhaust purification catalyst 20 is rapidly decreased.

Further, the unburned gas in the exhaust gas flowing into the upstream side exhaust purification catalyst 20 is purified at the upstream side exhaust purification catalyst 20. Therefore, after the end of fuel cut control, a substantially stoichiometric air-fuel ratio exhaust gas flows out from the upstream side exhaust purification catalyst 20 along with a certain amount of delay. Then, the air-fuel ratio of the exhaust gas flowing out from the upstream side exhaust purification catalyst 20 is maintained at substantially the stoichiometric air-fuel ratio, until the oxygen storage amount OSA of the upstream side exhaust purification catalyst 20 becomes substantially zero.

If, in this way, the air-fuel ratio of the exhaust gas flowing out from the upstream side exhaust purification catalyst 20 converges to and is maintained at the stoichiometric air-fuel ratio, the output air-fuel ratio AFdwn of the downstream side air-fuel ratio sensor 41 also converges to and is maintained at a certain value. In the example shown in FIG. 8, the output of the downstream side air-fuel ratio sensor 41 converges to a certain value at the time $t_3$, and is maintained at that value after the time $t_3$.

Then, if the oxygen storage amount OSA of the upstream side exhaust purification catalyst 20 becomes substantially zero, at the time $t_5$, the output air-fuel ratio AFdwn of the downstream side air-fuel ratio sensor 41 becomes the rich judged air-fuel ratio AFrich or less. If the output air-fuel ratio AFdwn of the downstream side air-fuel ratio sensor 41 becomes the rich judged air-fuel ratio AFrich or less, the post-return rich control is ended and normal air-fuel ratio control is started. If normal air-fuel ratio control is started, since the output air-fuel ratio AFdwn of the downstream side air-fuel ratio sensor 41 is the rich judged air-fuel ratio AFrich or less at the time $t_5$, the target air-fuel ratio AFT is switched to the lean set air-fuel ratio AFTlean.

In this regard, unless deviation occurs in the output air-fuel ratio AFdwn of the downstream side air-fuel ratio sensor 41, after the time $t_3$, the output air-fuel ratio AFdwn of the downstream side air-fuel ratio sensor 41 converges to substantially the stoichiometric air-fuel ratio. As opposed to this, if deviation occurs in the output air-fuel ratio AFdwn of the downstream side air-fuel ratio sensor 41, the output air-fuel ratio AFdwn of the downstream side air-fuel ratio sensor 41 converges to a value which is different from the stoichiometric air-fuel ratio. In particular, if the output air-fuel ratio AFdwn of the downstream side air-fuel ratio sensor 41 deviates to the rich side, the output air-fuel ratio AFdwn of the downstream side air-fuel ratio sensor 41 converges to a value at the rich side from the stoichiometric air-fuel ratio. Conversely, if the output air-fuel ratio AFdwn of the downstream side air-fuel ratio sensor 41 deviates to the lean side, the output air-fuel ratio AFdwn of the downstream side air-fuel ratio sensor 41 converges to a value at the lean side from the stoichiometric air-fuel ratio.

In the example shown in FIG. 8, after the time $t_3$, the output air-fuel ratio AFdwn of the downstream side air-fuel ratio sensor 41 converges to and is maintained at a value leaner than the stoichiometric air-fuel ratio. Therefore, it is learned that the output air-fuel ratio AFdwn of the downstream side air-fuel ratio sensor 41 deviates to the lean side.

Therefore, in the present embodiment, in the time period after the end of fuel cut control until the output air-fuel ratio AFdwn of the downstream side air-fuel ratio sensor 41 becomes the rich judged air-fuel ratio AFrich or less, the output air-fuel ratio AFdwn in the output stabilization time period Tst where the output air-fuel ratio AFdwn of the downstream side air-fuel ratio sensor 41 stabilizes is detected. Further, the air-fuel ratio difference ΔAF between the average value AFdwnav of the output air-fuel ratio AFdwn in the output stabilization time period Tst and the stoichiometric air-fuel ratio is calculated (ΔAF=14.6−AFdwnav).

In the present embodiment, the thus calculated air-fuel ratio difference ΔAF is multiplied with a correction coefficient $K_1$ to calculate the correction amount ΔAFdwn (following formula (2)).

$$\Delta AFdwn = K_1 \times \Delta AF \quad (2)$$

Note that, the correction coefficient $K_1$ is a coefficient which is larger than 0 and not more than 1 ($0<K_1\leq 1$) and is used to keep the output air-fuel ratio AFdwn of the downstream side air-fuel ratio sensor 41 from being excessively corrected. Then, if using the output air-fuel ratio of the downstream side air-fuel ratio sensor 41 (for example, when it is judged that the output air-fuel ratio is the rich judged air-fuel ratio or less), as shown in the following formula (3), the value acquired by adding the correction amount ΔAFdwn to the actual output air-fuel ratio AFdwnact of the downstream side air-fuel ratio sensor 41 is used.

$$AFdwn = AFdwnact + \Delta AFdwn \quad (3)$$

Note that, in the present embodiment, the output stabilization time period is the time period during which the amount of change per unit time of the output air-fuel ratio AFdwn of the downstream side air-fuel ratio sensor 41 can be judged to be a predetermined value (value by which it can be judged output has stabilized generally) or less. Therefore, in the example shown in FIG. 8, it is the time from the time $t_3$ when the amount of change per unit time of the output air-fuel ratio AFdwn of the downstream side air-fuel ratio sensor 41 becomes a predetermined value or less to time $t_4$ when the amount of change per unit time of the output air-fuel ratio AFdwn of the downstream side air-fuel ratio sensor 41 becomes a predetermined value or more. Further, the average value AFdwnav of the output air-fuel ratio in the output stabilization time period Tst may not be the average value of the output air-fuel ratio in the output stabilization time period Tst as a whole, but may be the average value of the output air-fuel ratio in part of the time period of the output stabilization time period Tst (including only single detection).

Advantageous Effect of Present Embodiment

As explained above, after the end of fuel cut control and during post-return rich control, substantially the stoichiometric air-fuel ratio exhaust gas flows out from the upstream side exhaust purification catalyst 20. According to the present embodiment, as explained above, in the output stabilization time period after the end of the above fuel cut control and when the output of the downstream side air-fuel ratio sensor 41 stabilizes, that is, in the time period during which it is anticipated that substantially the stoichiometric air-fuel ratio exhaust gas flows out from the upstream side exhaust purification catalyst 20, the output air-fuel ratio AFdwn of the downstream side air-fuel ratio sensor 41 is detected. Further, when the output air-fuel ratio AFdwn of the downstream side air-fuel ratio sensor 41 at this time is not the stoichiometric air-fuel ratio, the output air-fuel ratio AFdwn is corrected in accordance with the output air-fuel ratio AFdwn at this time. Accordingly, the deviation in the output air-fuel ratio AFdwn of the downstream side air-fuel ratio sensor 41 can be compensated for.

Further, when performing fuel cut control and post-return rich control, basically $NO_X$ does not flow out from the upstream side exhaust purification catalyst 20. Therefore, in compensating for deviation of the output air-fuel ratio AFdwn of the downstream side air-fuel ratio sensor 41, deterioration of the exhaust emissions in the exhaust gas exhausted from the upstream side exhaust purification catalyst 20 can be suppressed. Further, since fuel cut control, as explained above, is performed at the time of deceleration, etc., of a vehicle which mounts the internal combustion engine, the frequency of execution is relatively high. Therefore, it is also possible to compensate for deviation in the output air-fuel ratio AFdwn of the downstream side air-fuel ratio sensor 41 by a relatively high frequency.

Further, when performing fuel cut control, it is possible to purify the HC or sulfur ingredient stored in the precious metal which is carried at the upstream side exhaust purification catalyst 20. That is, if executing fuel cut control, HC poisoning or sulfur poisoning of the upstream side exhaust purification catalyst 20 can at least partially be reversed.

Therefore, during post-return rich control, the activity of the precious metal is relatively high. Therefore, after the time $t_2$ of FIG. 8, even if the air-fuel ratio of the exhaust gas flowing into the upstream side exhaust purification catalyst 20 becomes the rich air-fuel ratio, the unburned gas in the exhaust gas flowing into the upstream side exhaust purification catalyst 20 can be sufficiently purified. As a result, after the time $t_3$ of FIG. 8, the air-fuel ratio of the exhaust gas flowing out from the upstream side exhaust purification catalyst 20 is kept from deviating from the stoichiometric air-fuel ratio. In addition, since HC poisoning or sulfur poisoning of the upstream side exhaust purification catalyst 20 is reversed, the maximum storable oxygen amount becomes greater. Therefore, the output stabilization time period from the time $t_3$ to time $t_4$ becomes longer. Therefore, according to the present embodiment, it is possible to obtain the average value for a longer time period and accordingly possible to more accurately detect the amount of deviation of the output air-fuel ratio AFdwn of the downstream side air-fuel ratio sensor 41.

Note that, to sufficiently remove the HC or sulfur ingredient which is stored in the precious metal carried at the upstream side exhaust purification catalyst 20 at the time of fuel cut control, it is necessary that the temperature of the upstream side exhaust purification catalyst 20 during fuel cut control be a certain constant removable temperature or more. Therefore, deviation in the output air-fuel ratio AFdwn of the downstream side air-fuel ratio sensor 41 can be compensated for in the above way only when the temperature of the upstream side exhaust purification catalyst 20 during fuel cut control is a removable temperature or more.

Furthermore, in the present embodiment, fuel cut control is performed before switching the target air-fuel ratio to the rich air-fuel ratio at the time $t_2$. Therefore, the state of the upstream side exhaust purification catalyst 20 before detecting the amount of deviation of the output air-fuel ratio AFdwn of the downstream side air-fuel ratio sensor 41 is constant at all times. Accordingly, changing in the output air-fuel ratio AFdwn of the downstream side air-fuel ratio sensor 41 based on a difference in the state of the upstream side exhaust purification catalyst 20, can be suppressed. Due to this, when no deviation occurs in the output air-fuel ratio AFdwn of the downstream side air-fuel ratio sensor 41, the output air-fuel ratio AFdwn of the downstream side air-fuel ratio sensor 41 does not change based on the state of the upstream side exhaust purification catalyst 20, and as a result the output air-fuel ratio of the downstream side air-fuel ratio sensor 41 is suppressed from being mistakenly corrected.

Modifications of Embodiment

Note that, in the above embodiment, the output air-fuel ratio AFdwn of the downstream side air-fuel ratio sensor 41 is corrected based on the air-fuel ratio difference ΔAF. However, what is corrected need not necessarily be the output air-fuel ratio AFdwn of the downstream side air-fuel ratio sensor 41. It may also be a parameter which relates to the output air-fuel ratio of the downstream side air-fuel ratio sensor 41. Such a parameter, for example, may also be a rich judged air-fuel ratio AFrich or lean judged air-fuel ratio AFlean. In this case, when the output air-fuel ratio AFdwn of the downstream side air-fuel ratio sensor 41 deviates to the rich side, these rich judged air-fuel ratio AFrich and lean judged air-fuel ratio AFlean are corrected to the rich side. Conversely, when the output air-fuel ratio AFdwn of the downstream side air-fuel ratio sensor 41 deviates to the lean side, the rich judged air-fuel ratio AFrich and the lean judged air-fuel ratio AFlean are corrected to the lean side.

Further, in the above embodiment, the output stabilization time period Tst is the time period during which the amount of change per unit time of the output air-fuel ratio AFdwn of the downstream side air-fuel ratio sensor 41 is a predetermined value or less. Therefore, it is also possible to shorten the unit time and use a time derivative of the output air-fuel ratio AFdwn as the amount of change per unit time of the output air-fuel ratio AFdwn of the downstream side air-fuel ratio sensor 41.

Alternatively, the output stabilization time period Tst may be the time period during which it is anticipated that the amount of change per unit time of the output air-fuel ratio AFdwn of the downstream side air-fuel ratio sensor 41 will be a predetermined value or less. In this regard, the time period from the end of fuel cut control to when the output air-fuel ratio AFdwn of the downstream side air-fuel ratio sensor 41 stabilizes can be predicted to a certain extent from the maximum storable oxygen amount, etc., of the upstream side exhaust purification catalyst 20. Therefore, the output stabilization time period Tst may also be a time period starting from the time when the elapsed time after the end of fuel cut control becomes a predetermined reference time or more.

Similarly, the cumulative air intake amount or cumulative oxygen excess/deficiency in the period from the end of fuel cut control to when the output air-fuel ratio AFdwn of the downstream side air-fuel ratio sensor 41 stabilizes can also be predicted to a certain extent from the maximum storable oxygen amount of the upstream side exhaust purification catalyst 20, etc. Therefore, the output stabilization time period Tst may also be the time period after the cumulative air intake amount or cumulative oxygen excess/deficiency after the end of fuel cut control becomes a predetermined reference amount or more.

Further, since a certain degree of noise is present in the output air-fuel ratio AFdwn of the downstream side air-fuel ratio sensor 41, to accurately detect the output air-fuel ratio AFdwn, the output stabilization time period Tst has to be a certain extent of long time. Therefore, if the output stabilization time period Tst is shorter than a predetermined time, the output air-fuel ratio AFdwn of the downstream side air-fuel ratio sensor 41 may not be corrected.

Figure 9:
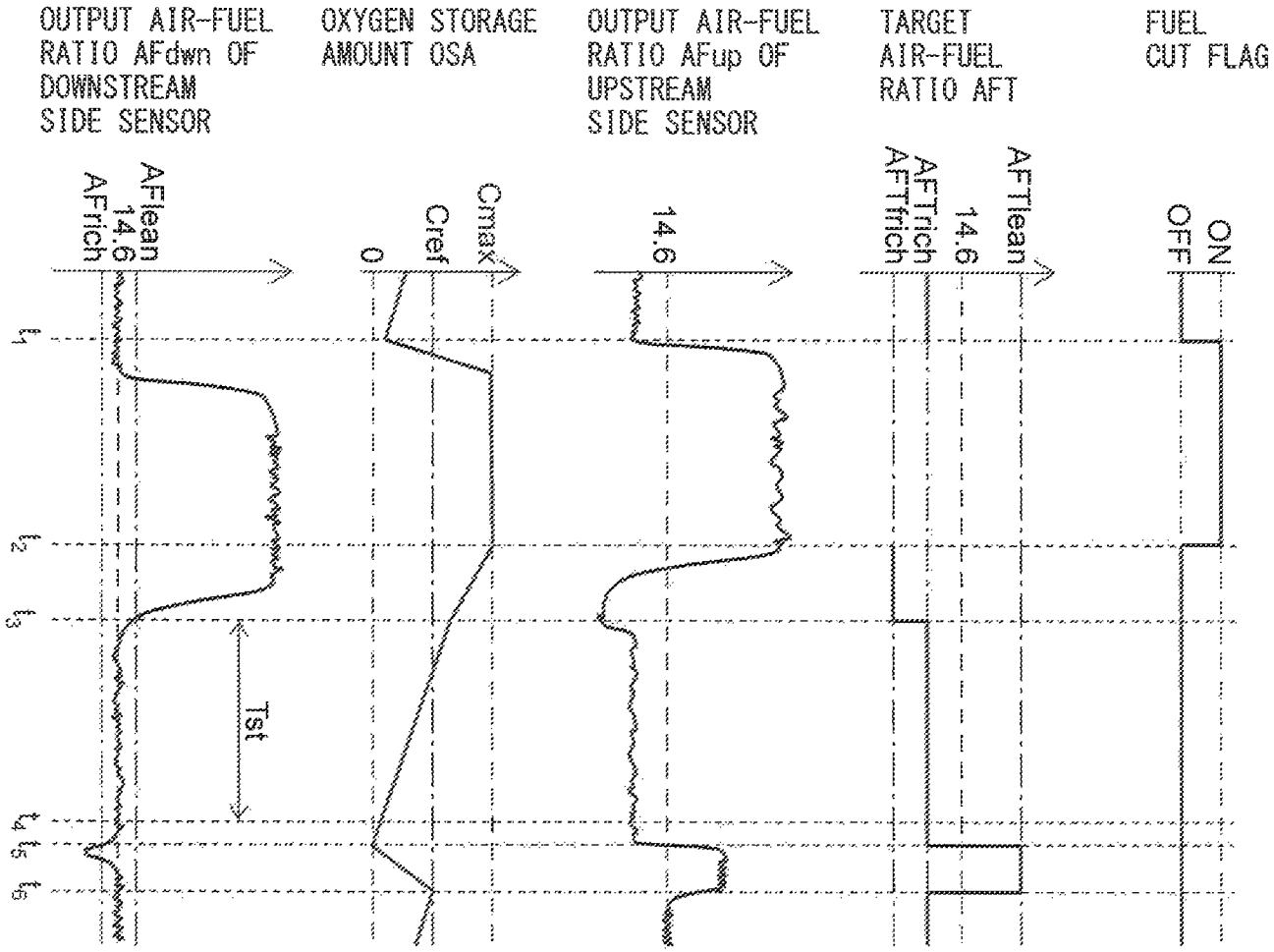
FIG. 9 is a time chart of a target air-fuel ratio, etc., at the time of execution of fuel cut control.

In addition, in the above embodiment, in the post-return rich control, the target air-fuel ratio is set constant at the post-return rich set air-fuel ratio AFTrich. However, as shown in FIG. 9, the target air-fuel ratio may also be changed so that the rich degree becomes lower during post-return rich control. In the example shown in FIG. 9, at the time $t_3$ when the output air-fuel ratio AFdwn of the downstream side air-fuel ratio sensor 41 becomes smaller than the lean judged air-fuel ratio AFlean during post-return rich control after the end of fuel cut control, the target air-fuel ratio AFT is changed from the post-return rich set air-fuel ratio AFTfrich to the rich set air-fuel ratio AFTrich. Accordingly, the speed of decrease of the oxygen storage amount OSA of the upstream side exhaust purification catalyst 20 becomes slower and therefore the output stabilization time period Tst becomes longer. By the output stabilization time period Tst becoming longer in this way, it is possible to increase the number of times of detection of the output air-fuel ratio AFdwn of the downstream side air-fuel ratio sensor 41 during the output stabilization time period Tst and accordingly possible to more accurately detect the value to which the output air-fuel ratio AFdwn converges.

Note that, in the example shown in FIG. 9, the rich degree of the target air-fuel ratio AFT is lowered when the output air-fuel ratio AFdwn of the downstream side air-fuel ratio sensor 41 becomes smaller than the lean judged air-fuel ratio AFlean. However, the rich degree of the target air-fuel ratio AFT may also be lowered at another timing. For example, the rich degree of the target air-fuel ratio AFT may also be lowered when the elapsed time from when the fuel cut control ends reaches a predetermined time, or the cumulative intake air amount or cumulative oxygen excess/deficiency from the end of fuel cut control becomes a predetermined amount. Therefore, if expressing these together, it can be said that the rich degree of the target air-fuel ratio is lowered at a predetermined timing after the end of the fuel cut control and before the output air-fuel ratio AFdwn of the downstream side air-fuel ratio sensor 41 becomes the rich judged air-fuel ratio AFrich or less.

Whatever the case, the control system of the present invention can execute fuel cut control which stops the feed of fuel to the internal combustion engine during operation of the internal combustion engine, and can execute post-return rich control which sets the air-fuel ratio of the exhaust gas flowing into the upstream side exhaust purification catalyst 20 to the rich air-fuel ratio after the end of the fuel cut control. Further, the control system of the present invention corrects the output air-fuel ratio AFdwn of the downstream side air-fuel ratio sensor or a parameter relating to the output air-fuel ratio AFdwn (for example, rich judged air-fuel ratio AFrich or lean judged air-fuel ratio AFlean), based on the difference between the output air-fuel ratio AFdwn and the stoichiometric air-fuel ratio in the output stabilization time period Tst which is defined as the time period when the amount of change of the output air-fuel ratio AFdwn of the downstream side air-fuel ratio sensor 41 per unit time is a predetermined value or less or is expected to be a predetermined value or less, within the time period after the end of fuel cut control and before the output air-fuel ratio of the downstream side air-fuel ratio sensor 41 becomes the rich judged air-fuel ratio AFrich or less. When correcting the output air-fuel ratio AFdwn of the downstream side air-fuel ratio sensor, the output air-fuel ratio AFdwn is corrected so that the difference between the output air-fuel ratio AFdwn at the output stabilization time period Tst and the stoichiometric air-fuel ratio becomes smaller. Further, when correcting a parameter relating to the output air-fuel ratio AFdwn, the parameter relating to the output air-fuel ratio AFdwn is corrected so that the difference between the output air-fuel ratio AFdwn at the output stabilization time period Tst and the stoichiometric air-fuel ratio becomes smaller.

<Flow Chart>

Figure 10:
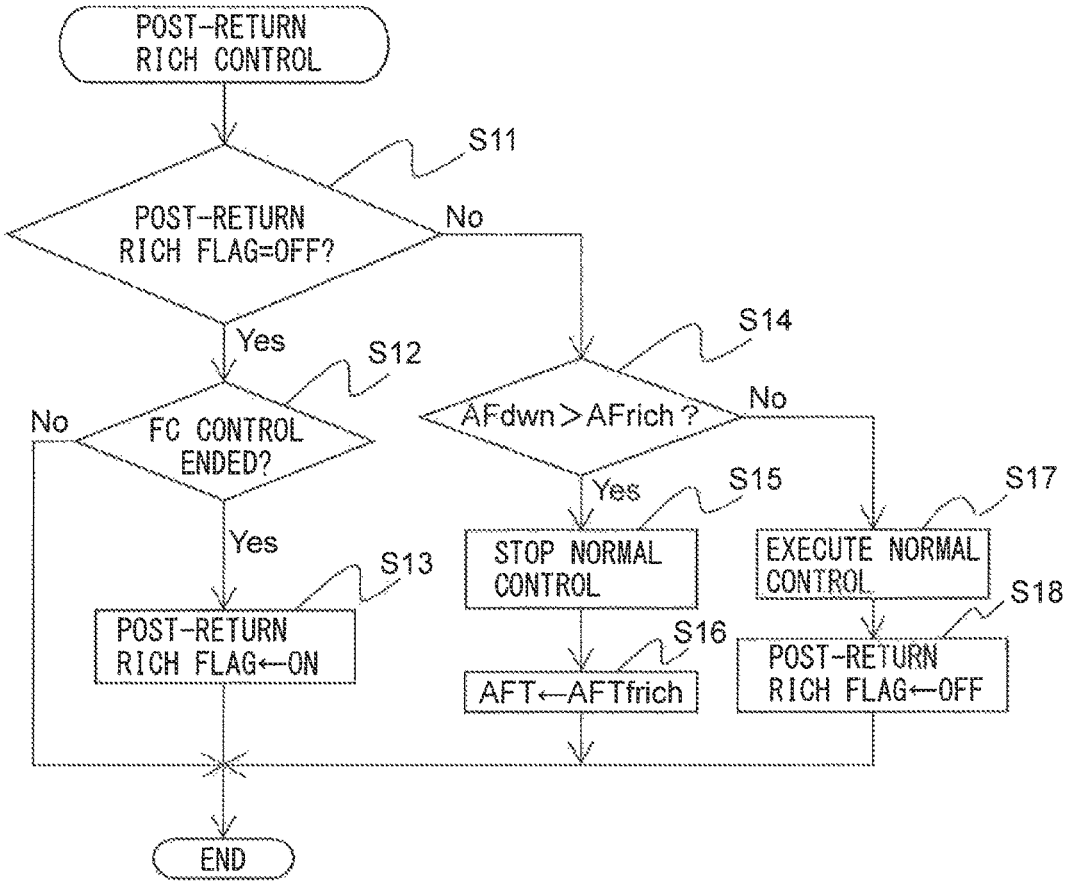
FIG. 10 is a flow chart which shows a control routine of post-return rich control.

FIG. 10 is a flow chart which shows a control routine for post-return rich control. The illustrated control routine is executed by interruption every certain time interval.

As shown in FIG. 10, first, at step S11, it is judged if the post-return rich flag is off. The post-return rich flag is a flag which is set on during execution of post-return rich control and which is set off otherwise. When it is judged at step S11 that the post-return rich flag is off, the routine proceeds to step S12. At step S12, it is judged if fuel cut control (FC control) has ended. When fuel cut control has still not started or even if fuel cut control has started but is still in progress, it is judged that fuel cut control has not ended and the control routine is ended.

Then, if fuel cut control is ended, at the next control routine, at step S12, it is judged that the fuel cut control has ended and the routine proceeds to step S13. At step S13, the post-return rich flag is set on and the control routine is ended.

If the post-return rich flag is set on, at the next control routine, the routine proceeds from step S11 to step S14. At step S14, it is judged if the output air-fuel ratio AFdwn of the downstream side air-fuel ratio sensor 41 is larger than the rich judged air-fuel ratio AFrich. If it is judged that the output air-fuel ratio AFdwn of the downstream side air-fuel ratio sensor 41 is larger than the rich judged air-fuel ratio AFrich, the routine proceeds to step S15. At step S15, normal air-fuel ratio control such as shown in FIG. 5 is stopped. Next, at step S16, the target air-fuel ratio AFT is set to the post-return rich set air-fuel ratio AFTfrich and the control routine is ended.

Then, if the output air-fuel ratio AFdwn of the downstream side air-fuel ratio sensor 41 becomes the rich judged air-fuel ratio AFrich or less, at the next control routine, the routine proceeds from step S14 to step S17. At step S17, normal air-fuel ratio control such as shown in FIG. 5 is started. Next, at step S18, the post-return rich flag is reset to off and the control routine is ended.

Figure 11:
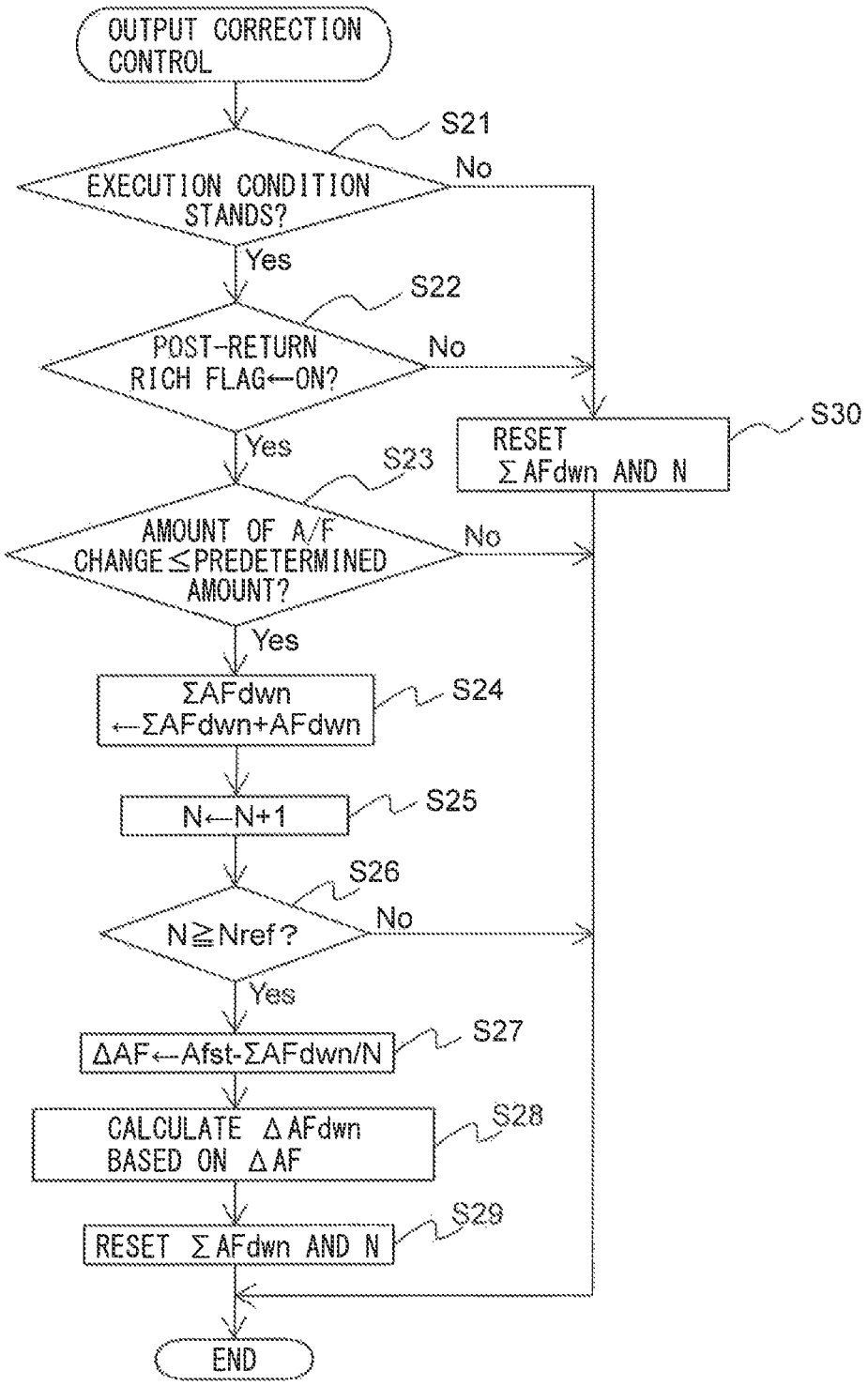
FIG. 11 is a flow chart which shows a control routine of correction control of an output air-fuel ratio of the downstream side air-fuel ratio sensor.

FIG. 11 is a flow chart which shows the control routine of correction control of the output air-fuel ratio AFdwn of the downstream side air-fuel ratio sensor 41. The illustrated control routine is executed by interruption every certain time interval.

First, at step S21, it is judged if the condition for execution of correction control of the output air-fuel ratio AFdwn stands. The condition for execution of correction control stands when, for example, the temperature of the downstream side air-fuel ratio sensor 41 is the activation temperature or more and a certain time or more has elapsed from execution of the previous correction control. When, at step S21, it is judged if the condition for execution of correction control of the output air-fuel ratio AFdwn stands, the routine proceeds to step S22.

At step S22, it is judged if a post-return rich flag which is used in the control routine of FIG. 10 has been set to on. That is, at step S22, it is judged if the time is after the fuel cut control has ended and before the output air-fuel ratio AFdwn of the downstream side air-fuel ratio sensor 41 has become the rich judged air-fuel ratio AFrich or less. When, at step S22, it is judged that the post-return rich flag has been set on, the routine proceeds to step S23. At step S23, it is judged if the amount change of the output air-fuel ratio AFdwn of the downstream side air-fuel ratio sensor 41 per unit time is a predetermined value or less, that is, if the output air-fuel ratio AFdwn has stabilized. When it is judged at step S23 that the amount of change of the output air-fuel ratio AFdwn per unit time is larger than a predetermined value, that is, when the output air-fuel ratio AFdwn has still not stabilized, the control routine is ended.

Then, if the output air-fuel ratio AFdwn stabilizes and the amount of change of the output air-fuel ratio AFdwn per unit time becomes a predetermined value or less, at the next control routine, the routine proceeds from step S23 to step S24. At step S24, the new output air-fuel ratio cumulative value ΣAFdwn is set to a value acquired by adding the current output air-fuel ratio AFdwn to the output air-fuel ratio cumulative value ΣAFdwn which is obtained by cumulatively adding the output air-fuel ratio AFdwn of the downstream side air-fuel ratio sensor 41. Next, at step S25, the new cumulative number N is set to a number acquired by adding 1 to the cumulative number N.

Then, at step S26, it is judged if the cumulative number N is a predetermined reference number Nref or more. The reference number Nref is equal to or greater than a number of times when the converged value can be suitably calculated even if noise appears in the output air-fuel ratio AFdwn of the downstream side air-fuel ratio sensor 41. When it is judged at step S26 that the cumulative number N is smaller than the reference number Nref, the control routine is ended.

On the other hand, if the cumulative number N increases and becomes the reference number Nref or more, at the next control routine, the routine proceeds from step S26 to step S27. At step S27, the output air-fuel ratio cumulative value ΣAFdwn which is calculated at step S24 is divided by the cumulative number N, and from the thus calculated value, the stoichiometric air-fuel ratio AFst is subtracted to obtain the air-fuel ratio difference ΔAF. Next, at step S28, the correction amount ΔAFdwn of the output air-fuel ratio of the downstream side air-fuel ratio sensor 41 is calculated based on the above formula (2). The thus calculated correction amount ΔAFdwn is used when calculating the output air-fuel ratio AFdwn of the downstream side air-fuel ratio sensor 41 based on the above-mentioned formula (3). Then, at step S29, the output air-fuel ratio cumulative value ΣAFdwn and cumulative number N are reset, and then the control routine is ended.

On the other hand, when it is judged at step S21 that the condition for execution of correction control of the output air-fuel ratio AFdwn does not stand, and when it is judged at step S22 that the post-return rich flag has been set off, the routine proceeds to step S30. At step S30, the output air-fuel ratio cumulative value ΣAFdwn and cumulative number N is reset, and then the control routine is ended.

REFERENCE SIGNS LIST 1 engine body
5 combustion chamber
7 intake port
9 exhaust port
19 exhaust manifold
20 upstream side exhaust purification catalyst
24 downstream side exhaust purification catalyst
31 ECU
40 upstream side air-fuel ratio sensor
41 downstream side air-fuel ratio sensor

The invention claimed is:

1. A control system of an internal combustion engine, the engine comprising: an exhaust purification catalyst which is arranged in an exhaust passage of the internal combustion engine and can store oxygen; and a downstream side air-fuel ratio sensor which is arranged at the downstream side, in the direction of flow of exhaust, of said exhaust purification catalyst, and which detects an air-fuel ratio of exhaust gas flowing out from said exhaust purification catalyst, wherein the control system of the internal combustion engine includes an electronic control unit, and wherein the control system of the internal combustion engine:

is configured to be able to perform fuel cut control which stops the feed of fuel to the internal combustion engine during operation of the internal combustion engine;

is configured to perform, after the end of fuel cut control, post-return rich control which sets the air-fuel ratio of exhaust gas flowing into said exhaust purification catalyst to a rich air-fuel ratio which is richer than the stoichiometric air-fuel ratio;

is configured to determine a difference between the stoichiometric air-fuel ratio and the output air-fuel ratio of the downstream side air-fuel ratio sensor in the output stabilization time period which is a time period when the amount of change per unit time of the output air-fuel ratio of said downstream side air-fuel ratio sensor is a predetermined value or less or is anticipated as becoming a predetermined value or less, in the time period after the end of said fuel cut control and before the output air-fuel ratio of the downstream side air-fuel ratio sensor becomes a rich judged air-fuel ratio, which is richer than the stoichiometric air-fuel ratio, or less; and is configured to correct the output air-fuel ratio of said downstream side air-fuel ratio sensor or a parameter relating to said output air-fuel ratio, based on the difference, so that the difference becomes smaller.

2. The control system of an internal combustion engine according to claim 1, wherein said output stabilization time period is a time period after when an elapsed time after the end of fuel cut control becomes a predetermined reference time or more.

3. The control system of an internal combustion engine according to claim 1, wherein said output stabilization time period is a time period after when a cumulative oxygen excess/deficiency after the end of said fuel cut control becomes a predetermined reference amount or more.

4. The control system of an internal combustion engine according to claim 1, wherein said output stabilization time period is a time period after a time derivative in the output air-fuel ratio of said downstream side air-fuel ratio sensor becomes a predetermined reference value or less.

5. The control system of an internal combustion engine according to claim 1, wherein as the output air-fuel ratio of said downstream side air-fuel ratio sensor in said output stabilization time period, the average value of the output air-fuel ratio of said downstream side air-fuel ratio sensor which is detected a plurality of times during said output stabilization time period is used.

6. The control system of an internal combustion engine according to claim 1, wherein the control system is configured, in said post-return rich control, to lower the rich degree of the air-fuel ratio of the exhaust gas flowing into said exhaust purification catalyst, in a predetermined time after the end of said fuel cut control and before the output air-fuel ratio of said downstream side air-fuel ratio sensor becomes a rich judged air-fuel ratio or less.

7. The control system of an internal combustion engine according to claim 6, wherein as the output air-fuel ratio of said downstream side air-fuel ratio sensor in said output stabilization time period, the average value of the output air-fuel ratio of said downstream side air-fuel ratio sensor which is detected a plurality of times during said output stabilization time period is used.

8. The control system of an internal combustion engine according to claim 1, wherein said control system can perform normal control when said fuel cut control and said post-return rich control are not being performed, in said normal control, feedback control is performed so that an air-fuel ratio of exhaust gas flowing into said exhaust purification catalyst becomes a target air-fuel ratio, and said control system is configured to switch said target air-fuel ratio to a lean air-fuel ratio which is leaner than the stoichiometric air-fuel ratio, when the air-fuel ratio detected by said downstream side air-fuel ratio sensor becomes a rich judged air-fuel ratio or less, and switch said target air-fuel ratio to a rich air-fuel ratio which is richer than the stoichiometric air-fuel ratio, when it is estimated that said oxygen storage amount of the exhaust purification catalyst from when said target air-fuel ratio is switched to the lean air-fuel ratio, becomes a predetermined switching reference storage amount, which is smaller than the maximum storable oxygen amount, or more.

9. The control system of an internal combustion engine according to claim 8, wherein as the output air-fuel ratio of said downstream side air-fuel ratio sensor in said output stabilization time period, the average value of the output air-fuel ratio of said downstream side air-fuel ratio sensor which is detected a plurality of times during said output stabilization time period is used.

10. The control system of an internal combustion engine according to claim 8, wherein the control system is configured, in said post-return rich control, to lower the rich degree of the air-fuel ratio of the exhaust gas flowing into said exhaust purification catalyst, in a predetermined time after the end of said fuel cut control and before the output air-fuel ratio of said downstream side air-fuel ratio sensor becomes a rich judged air-fuel ratio or less.

11. The control system of an internal combustion engine according to claim 10, wherein as the output air-fuel ratio of said downstream side air-fuel ratio sensor in said output stabilization time period, the average value of the output air-fuel ratio of said downstream side air-fuel ratio sensor which is detected a plurality of times during said output stabilization time period is used.

* * * * *